US008216096B2

(12) United States Patent
McGrath et al.

(10) Patent No.: US 8,216,096 B2
(45) **Date of Patent: *Jul. 10, 2012**

(54) HOCKEY STICK

(75) Inventors: Michael J. McGrath, Coronado, CA (US); Roman D. Halko, Chula Vista, CA (US); Edward M. Goldsmith, Studio City, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/154,249

(22) Filed: Jun. 6, 2011

(65) Prior Publication Data

US 2011/0237365 A1 Sep. 29, 2011

Related U.S. Application Data

(63) Continuation of application No. 10/439,652, filed on May 15, 2003, now Pat. No. 7,963,868, which is a continuation-in-part of application No. 10/290,052, filed on Nov. 6, 2002, now abandoned, which is a continuation of application No. 09/663,598, filed on Sep. 15, 2000, now abandoned.

(60) Provisional application No. 60/380,900, filed on May 15, 2002, provisional application No. 60/418,067, filed on Oct. 11, 2002.

(51) Int. Cl.
*A63B 59/14* (2006.01)

(52) U.S. Cl. ..... 473/563

(58) Field of Classification Search ..... 473/560–563
See application file for complete search history.

(56) References Cited

U.S. PATENT DOCUMENTS

| | | | | |
|---|---|---|---|---|
| 1,601,116 | A | 9/1926 | Hall | |
| 2,201,706 | A | 5/1940 | Sukohl | 154/40 |
| 2,304,322 | A | 12/1942 | Werlich | 273/67 |
| 2,649,133 | A | 8/1953 | Just | 154/1.8 |
| 2,674,557 | A | 4/1954 | Boggs | 154/83 |
| 2,762,739 | A | 9/1956 | Weiss | 154/90 |
| 2,774,596 | A | 12/1956 | Bredenberg | 273/67 |
| 2,912,245 | A | 11/1959 | Gardner et al. | 273/67 |
| 2,964,065 | A | 12/1960 | Haroldson | 138/76 |
| 3,020,192 | A | 2/1962 | Stephens et al. | 156/423 |
| 3,125,478 | A | 3/1964 | Pratt | 156/184 |
| 3,353,826 | A | 11/1967 | Traverse | 273/67 |
| 3,489,412 | A | 1/1970 | Franck et al. | 273/67 |
| 3,533,623 | A | 10/1970 | Dumont | 273/67 |

(Continued)

FOREIGN PATENT DOCUMENTS

CA 489072 12/1952

(Continued)

OTHER PUBLICATIONS

Polyurathane Foam Association, Joint Industry Foam Standards and Guidelines, Jul. 1994, 5 pages from website.

(Continued)

*Primary Examiner* — Mark Graham
(74) *Attorney, Agent, or Firm* — Perkins Coie LLP

(57) ABSTRACT

Hockey stick configurations and hockey stick blade constructs are disclosed. The blade is comprised of one or more inner core elements, surrounded by one or more walls made of reinforcing fibers or filaments disposed in a hardened matrix resin material. One or more of the inner core elements comprises an elastomer material.

16 Claims, 20 Drawing Sheets

U.S. PATENT DOCUMENTS

| | | | | | |
|---|---|---|---|---|---|
| 3,544,104 | A | | 12/1970 | Jenks | 272/66 |
| 3,561,760 | A | | 2/1971 | Klay | 273/67 |
| 3,563,546 | A | | 2/1971 | Dawe | 273/67 |
| 3,606,326 | A | | 9/1971 | Sparks et al. | |
| 3,631,897 | A | | 1/1972 | Fischer et al. | 138/141 |
| 3,638,942 | A | | 2/1972 | Bassett | 273/67 A |
| 3,720,410 | A | | 3/1973 | Saytar | 273/67 A |
| 3,727,936 | A | | 4/1973 | Klir et al. | 280/11.13 L |
| 3,809,401 | A | | 5/1974 | Hankele | 273/67 A |
| 3,813,098 | A | | 5/1974 | Fischer et al. | 273/72 R |
| 3,851,880 | A | | 12/1974 | Ritch | 273/128 R |
| 3,859,162 | A | | 1/1975 | Johnson et al. | 161/160 |
| 3,910,578 | A | | 10/1975 | Brine, Jr. | 273/96 D |
| 3,934,875 | A | | 1/1976 | Easton et al. | 273/67 A |
| 3,961,790 | A | | 6/1976 | Milligan | 273/67 A |
| 3,970,324 | A | | 7/1976 | Howat | 280/610 |
| 3,982,760 | A | | 9/1976 | Tiitola | 273/67 A |
| 4,013,288 | A | | 3/1977 | Goverde | 273/67 A |
| 4,013,810 | A | | 3/1977 | Long | 428/308 |
| 4,016,640 | A | | 4/1977 | Briggs | |
| D244,790 | S | | 6/1977 | Carlson et al. | |
| 4,052,499 | A | | 10/1977 | Goupil et al. | 264/265 |
| 4,059,269 | A | | 11/1977 | Tiitola | 273/67 A |
| 4,061,520 | A | | 12/1977 | Cecka et al. | 156/245 |
| 4,070,020 | A | | 1/1978 | Dano | 273/73 F |
| 4,070,021 | A | | 1/1978 | Cecka et al. | 273/73 F |
| 4,076,240 | A | | 2/1978 | Haddad | 273/67 A |
| 4,084,818 | A | | 4/1978 | Goupil et al. | 273/67 A |
| 4,086,115 | A | | 4/1978 | Sweet, Jr. et al. | 156/178 |
| 4,124,208 | A | * | 11/1978 | Burns | 473/562 |
| 4,124,670 | A | | 11/1978 | Cecka et al. | 264/45.3 |
| 4,128,963 | A | | 12/1978 | Dano | 264/46.6 |
| 4,129,634 | A | | 12/1978 | Cecka et al. | 264/45.3 |
| 4,134,198 | A | | 1/1979 | Briggs | |
| 4,134,587 | A | | 1/1979 | Diederich | 273/67 A |
| 4,148,482 | A | | 4/1979 | Harwell, Jr. et al. | 273/67 A |
| 4,159,114 | A | | 6/1979 | Ardell et al. | 273/67 A |
| 4,172,594 | A | | 10/1979 | Diederich | 237/67 A |
| 4,180,413 | A | | 12/1979 | Diederich | 156/185 |
| 4,200,479 | A | | 4/1980 | Ardell et al. | 156/154 |
| 4,212,461 | A | | 7/1980 | Cecka et al. | 273/73 F |
| 4,239,215 | A | | 12/1980 | Farr | 273/29 A |
| 4,241,115 | A | | 12/1980 | Temin | 427/384 |
| 4,273,601 | A | | 6/1981 | Weingart | 156/189 |
| 4,320,160 | A | | 3/1982 | Nishimura et al. | 428/107 |
| 4,343,468 | A | | 8/1982 | Lindgren | 273/67 A |
| 4,351,528 | A | | 9/1982 | Duplin | 273/67 A |
| 4,353,549 | A | | 10/1982 | Goupil et al. | 273/67 A |
| 4,358,113 | A | * | 11/1982 | McKinnon et al. | 473/561 |
| 4,358,117 | A | | 11/1982 | Deutsch | 273/326 |
| 4,361,325 | A | | 11/1982 | Jansen | 273/67 A |
| 4,369,970 | A | | 1/1983 | Salminen | 273/67 A |
| 4,461,479 | A | | 7/1984 | Mitchell | 273/81 A |
| 4,488,721 | A | * | 12/1984 | Franck et al. | 473/563 |
| 4,504,344 | A | | 3/1985 | Helle et al. | 156/185 |
| 4,512,573 | A | | 4/1985 | Coolen | 273/67 A |
| 4,520,042 | A | | 5/1985 | Smith | 427/209 |
| 4,537,398 | A | | 8/1985 | Salminen | 273/67 A |
| 4,570,932 | A | | 2/1986 | Cote | 273/67 A |
| 4,579,617 | A | | 4/1986 | Öberg et al. | 156/184 |
| 4,591,155 | A | | 5/1986 | Adachi | 273/67 A |
| 4,600,192 | A | | 7/1986 | Adachi | 273/67 A |
| 4,651,990 | A | | 3/1987 | Profit | 273/67 A |
| 4,660,832 | A | | 4/1987 | Shomo | 273/73 J |
| 4,664,379 | A | | 5/1987 | Melby | 273/67 A |
| 4,684,130 | A | | 8/1987 | Drolet et al. | 273/67 A |
| 4,739,994 | A | | 4/1988 | Lewis, Jr. | 273/326 |
| 4,765,856 | A | | 8/1988 | Doubt | 156/212 |
| 4,770,915 | A | | 9/1988 | Nakagawa et al. | 428/74 |
| 4,793,616 | A | | 12/1988 | Fernandez | 273/167 H |
| 4,799,985 | A | | 1/1989 | McMahon et al. | 156/166 |
| 4,818,318 | A | | 4/1989 | McMahon et al. | 156/166 |
| 4,871,491 | A | | 10/1989 | McMahon et al. | 264/29.2 |
| 4,874,563 | A | | 10/1989 | McMahon et al. | 264/29.2 |
| 4,923,541 | A | | 5/1990 | Burger | 156/87 |
| 4,968,032 | A | | 11/1990 | Redekop | 273/67 A |
| 4,979,743 | A | | 12/1990 | Sears | |
| 5,005,254 | A | | 4/1991 | Uffindell | |
| 5,024,712 | A | | 6/1991 | Lecourt et al. | 156/184 |
| 5,042,804 | A | | 8/1991 | Uke et al. | 273/75 |
| 5,042,805 | A | | 8/1991 | Nakai | 273/80 B |
| 5,048,441 | A | | 9/1991 | Quigley | 114/90 |
| 5,050,289 | A | | 9/1991 | Uffindell | |
| 5,050,878 | A | | 9/1991 | Deleris | 273/67 A |
| 5,067,726 | A | | 11/1991 | Brine, III et al. | 273/326 |
| 5,076,872 | A | | 12/1991 | Nakagawa et al. | 156/166 |
| 5,078,396 | A | | 1/1992 | Cavallaro et al. | 273/67 A |
| 5,127,649 | A | | 7/1992 | Carbeonero | 273/67 A |
| D329,888 | S | | 9/1992 | Christian | |
| 5,160,135 | A | | 11/1992 | Hasegawa | 273/67 A |
| 5,174,567 | A | | 12/1992 | Nordstrom | 273/67 A |
| 5,183,264 | A | | 2/1993 | Lanctot | 273/67 A |
| 5,188,872 | A | | 2/1993 | Quigley | 428/36.2 |
| 5,206,085 | A | | 4/1993 | Nakagawa et al. | 428/372 |
| 5,217,221 | A | * | 6/1993 | Baum | 473/561 |
| 5,242,637 | A | | 9/1993 | Inoue et al. | 264/45.3 |
| 5,261,662 | A | | 11/1993 | Prevost | 273/67 A |
| 5,303,916 | A | | 4/1994 | Rodgers | 273/67 A |
| 5,306,003 | A | | 4/1994 | Pagotto | 273/67 A |
| 5,312,100 | A | | 5/1994 | Ilacqua et al. | 273/67 A |
| 5,332,212 | A | | 7/1994 | Susi et al. | 273/67 A |
| 5,333,857 | A | | 8/1994 | Lallemand | 273/67 A |
| 5,364,693 | A | | 11/1994 | Moren et al. | 428/263 |
| 5,373,616 | A | | 12/1994 | Biersdorf et al. | |
| 5,380,002 | A | | 1/1995 | Spector | 273/58 H |
| 5,407,195 | A | * | 4/1995 | Tiitola et al. | 473/563 |
| 5,419,553 | A | | 5/1995 | Rodgors | 273/67 A |
| 5,423,531 | A | | 6/1995 | Hoshizaki et al. | 273/67 A |
| 5,423,735 | A | | 6/1995 | Callinan et al. | 602/8 |
| 5,429,352 | A | | 7/1995 | Leclerc | |
| 5,435,548 | A | | 7/1995 | Leduke et al. | 273/67 A |
| 5,439,215 | A | | 8/1995 | Ratchford | 273/67 A |
| 5,456,463 | A | | 10/1995 | Dolan et al. | 273/67 A |
| 5,458,330 | A | | 10/1995 | Baum | 273/72 R |
| RE35,081 | E | | 11/1995 | Quigley | 428/36.2 |
| 5,470,067 | A | | 11/1995 | Diresta | 273/57.2 |
| 5,492,425 | A | | 2/1996 | Carter et al. | 401/10 |
| 5,496,027 | A | | 3/1996 | Christian et al. | 273/67 A |
| 5,511,776 | A | | 4/1996 | Huru | 273/67 A |
| 5,520,385 | A | | 5/1996 | Quigley et al. | 273/57.2 |
| 5,524,884 | A | | 6/1996 | Haines | 273/67 R |
| 5,533,723 | A | | 7/1996 | Baum | 273/72 R |
| 5,549,947 | A | | 8/1996 | Quigley et al. | 428/36.2 |
| 5,556,677 | A | | 9/1996 | Quigley et al. | 428/36.2 |
| 5,558,326 | A | | 9/1996 | Adamson et al. | 273/67 A |
| 5,577,725 | A | | 11/1996 | Pagotto et al. | 273/67 A |
| 5,582,405 | A | | 12/1996 | Montgomery | 273/67 A |
| 5,582,406 | A | | 12/1996 | Babcock | 273/67 A |
| 5,593,158 | A | | 1/1997 | Filice et al. | 473/520 |
| 5,599,242 | A | | 2/1997 | Solviche et al. | 473/318 |
| 5,603,498 | A | | 2/1997 | Crawford et al. | 473/563 |
| 5,605,327 | A | | 2/1997 | McCutchen | |
| 5,607,154 | A | | 3/1997 | Meumann et al. | 473/562 |
| 5,607,226 | A | | 3/1997 | Toth et al. | 362/251 |
| 5,624,115 | A | | 4/1997 | Baum | 473/567 |
| 5,628,509 | A | | 5/1997 | Christian | 473/562 |
| 5,633,299 | A | | 5/1997 | Van Druten et al. | 524/14 |
| 5,636,836 | A | | 6/1997 | Carroll et al. | 473/561 |
| 5,653,468 | A | | 8/1997 | Ostapyk | 280/809 |
| 5,653,643 | A | | 8/1997 | Falone et al. | 473/300 |
| 5,655,981 | A | | 8/1997 | Reed | 473/560 |
| 5,674,141 | A | | 10/1997 | Laforest | 473/559 |
| 5,676,608 | A | | 10/1997 | Christian et al. | 473/563 |
| 5,685,791 | A | | 11/1997 | Feeney | 473/513 |
| 5,685,792 | A | | 11/1997 | Ruoff | 473/563 |
| 5,688,571 | A | | 11/1997 | Quigley et al. | 428/36.1 |
| 5,690,850 | A | | 11/1997 | Anderson | 219/535 |
| 5,695,416 | A | | 12/1997 | Christian | 473/562 |
| 5,697,857 | A | | 12/1997 | Christian et al. | 473/563 |
| 5,700,533 | A | | 12/1997 | You | 428/36.3 |
| 5,718,647 | A | | 2/1998 | Tiitola | 473/562 |
| 5,728,008 | A | | 3/1998 | Howard | 473/308 |
| 5,728,016 | A | | 3/1998 | Hsu | 473/563 |
| 5,744,528 | A | | 4/1998 | Callinan et al. | 524/265 |
| 5,746,955 | A | | 5/1998 | Calapp et al. | 264/103 |
| 5,772,541 | A | | 6/1998 | Buiatti | 473/520 |
| 5,816,949 | A | | 10/1998 | Dutchburn | 473/563 |

| | | | | |
|---|---|---|---|---|
| 5,816,962 | A | 10/1998 | Etersque | 473/563 |
| 5,816,963 | A | 10/1998 | Brooks et al. | 473/564 |
| 5,823,901 | A | 10/1998 | Burger | 473/560 |
| 5,827,141 | A | 10/1998 | Lukey et al. | 473/563 |
| 5,839,977 | A | 11/1998 | Maurer et al. | 473/446 |
| D404,449 | S | 1/1999 | Burger | |
| 5,863,268 | A | 1/1999 | Birch | 473/563 |
| 5,863,269 | A | 1/1999 | Filice | 473/562 |
| 5,865,694 | A | 2/1999 | Duong-Van | 473/520 |
| 5,865,696 | A | 2/1999 | Calapp et al. | 473/561 |
| 5,866,051 | A | 2/1999 | Lin et al. | 264/45.9 |
| 5,879,250 | A | 3/1999 | Tahtinen et al. | 473/561 |
| 5,888,601 | A | 3/1999 | Quigley et al. | 428/36.1 |
| 5,904,873 | A | 5/1999 | Sadler et al. | 219/535 |
| 5,928,090 | A | 7/1999 | Cabales et al. | 473/318 |
| D412,544 | S | 8/1999 | Burger | |
| 5,935,027 | A | 8/1999 | Nashif et al. | |
| 5,943,767 | A | 8/1999 | Milam | 29/800 |
| 5,944,617 | A | 8/1999 | Falone et al. | |
| 5,967,913 | A | 10/1999 | Sulenta | 473/560 |
| 5,979,288 | A | 11/1999 | Gallagher et al. | 87/36 |
| 5,980,404 | A | 11/1999 | Gentile | 473/560 |
| 5,980,674 | A | 11/1999 | Burger | 156/189 |
| 5,997,970 | A | 12/1999 | You | 428/36.2 |
| 6,001,035 | A | 12/1999 | Roberts | 473/562 |
| 6,004,900 | A | 12/1999 | O'Brien, III | 503/227 |
| 6,019,691 | A | 2/2000 | Hilborn | 473/563 |
| 6,033,326 | A | 3/2000 | Lee | 473/560 |
| 6,033,327 | A | 3/2000 | Bird | 473/560 |
| 6,033,328 | A | 3/2000 | Bellefleur et al. | 473/561 |
| 6,036,610 | A | 3/2000 | Lewark | 473/564 |
| 6,039,661 | A | 3/2000 | Christian et al. | 473/562 |
| 6,042,485 | A | 3/2000 | Cheng | |
| 6,045,906 | A | 4/2000 | McMahon et al. | 428/364 |
| 6,062,995 | A | 5/2000 | Murphy et al. | 473/562 |
| 6,062,996 | A * | 5/2000 | Quigley et al. | 473/563 |
| 6,063,839 | A | 5/2000 | Oosedo et al. | 523/206 |
| D430,249 | S | 8/2000 | Burger | |
| 6,102,819 | A | 8/2000 | Christian et al. | 473/563 |
| D431,273 | S | 9/2000 | Burger | |
| 6,113,508 | A | 9/2000 | Locarno et al. | 473/516 |
| 6,117,029 | A | 9/2000 | Kunisaki et al. | 473/561 |
| 6,129,962 | A | 10/2000 | Quigley et al. | 428/36.1 |
| 6,152,840 | A | 11/2000 | Baum | 473/564 |
| 6,155,932 | A | 12/2000 | Cabales et al. | 473/319 |
| 6,176,640 | B1 | 1/2001 | Gonczi | 403/375 |
| 6,183,384 | B1 | 2/2001 | Roberto | 473/563 |
| 6,197,392 | B1 | 3/2001 | Jones | |
| 6,203,447 | B1 | 3/2001 | Dillard | 473/316 |
| 6,203,454 | B1 | 3/2001 | Nashif et al. | |
| 6,206,793 | B1 | 3/2001 | Burger | 473/561 |
| D440,617 | S | 4/2001 | Goldsmith et al. | |
| 6,224,505 | B1 | 5/2001 | Burger | 473/561 |
| 6,234,923 | B1 | 5/2001 | Gentile | 473/563 |
| 6,241,633 | B1 | 6/2001 | Conroy | 473/561 |
| 6,248,031 | B1 | 6/2001 | Brodie | 473/560 |
| 6,250,193 | B1 | 6/2001 | Head | 87/2 |
| 6,257,997 | B1 | 7/2001 | Doble et al. | 473/516 |
| 6,265,475 | B1 | 7/2001 | Chifei et al. | |
| 6,267,697 | B1 | 7/2001 | Sulenta | 473/560 |
| 6,273,829 | B1 | 8/2001 | Carlson et al. | 473/316 |
| 6,273,835 | B1 | 8/2001 | Battis et al. | 473/563 |
| 6,274,230 | B1 | 8/2001 | Sarrelongue et al. | 428/293.7 |
| 6,306,474 | B1 | 10/2001 | Yoshioka et al. | 428/36.4 |
| 6,352,485 | B1 | 3/2002 | Philpot et al. | 473/564 |
| 6,358,166 | B1 | 3/2002 | Yu | 473/561 |
| 6,364,792 | B1 | 4/2002 | Evanochko | 473/560 |
| 6,364,793 | B1 | 4/2002 | Valarik | 473/563 |
| 6,395,210 | B1 | 5/2002 | Head et al. | 264/137 |
| D458,329 | S | 6/2002 | Clark et al. | |
| 6,399,199 | B1 | 6/2002 | Fujino et al. | 428/396 |
| 6,403,504 | B1 | 6/2002 | McMahon et al. | 442/197 |
| 6,500,079 | B1 | 12/2002 | Tucker | |
| 6,515,081 | B2 | 2/2003 | Oosedo et al. | 525/531 |
| 6,525,125 | B1 | 2/2003 | Giardello et al. | 524/439 |
| 6,565,280 | B1 | 5/2003 | Post | 403/325 |
| 6,610,382 | B1 | 8/2003 | Kobe et al. | 428/119 |
| 7,044,870 | B2 | 5/2006 | Pagotto | |
| 7,097,577 | B2 | 8/2006 | Goldsmith et al. | 473/563 |
| 7,326,136 | B2 | 2/2008 | Jean | |
| 7,422,532 | B2 * | 9/2008 | Goldsmith et al. | 473/563 |
| 7,789,778 | B2 | 9/2010 | Goldsmith et al. | |
| 7,862,456 | B2 * | 1/2011 | Halko et al. | 473/561 |
| 7,963,868 | B2 * | 6/2011 | McGrath et al. | 473/563 |
| 2001/0018378 | A1 | 8/2001 | Burger | |
| 2001/0029813 | A1 | 10/2001 | Schroder | |
| 2001/0041633 | A1 | 11/2001 | Tiitola | |
| 2001/0046909 | A1 * | 11/2001 | Pagotto | 473/563 |
| 2001/0046910 | A1 | 11/2001 | Sutherland | |
| 2002/0007022 | A1 | 1/2002 | Oosedo et al. | |
| 2002/0061374 | A1 | 5/2002 | O'Brien | |
| 2002/0073620 | A1 | 6/2002 | Lank | |
| 2002/0094891 | A1 | 7/2002 | Horwood et al. | |
| 2002/0098924 | A1 | 7/2002 | Houser et al. | |
| 2002/0107095 | A1 | 8/2002 | Becker | |
| 2002/0128093 | A1 | 9/2002 | Whayne | |
| 2002/0166595 | A1 | 11/2002 | Lindsay | |
| 2002/0177497 | A1 | 11/2002 | Westerlund | |
| 2002/0198071 | A1 | 12/2002 | Snow | |
| 2003/0004019 | A1 | 1/2003 | Lussier et al. | |
| 2003/0008734 | A1 | 1/2003 | Tiitola | |
| 2003/0045380 | A1 | 3/2003 | Tucker | |
| 2003/0084756 | A1 | 5/2003 | Schroder et al. | |
| 2005/0090339 | A1 | 4/2005 | Gans et al. | |
| 2009/0054180 | A1 | 2/2009 | Garcia | |

FOREIGN PATENT DOCUMENTS

| | | |
|---|---|---|
| CA | 557838 | 5/1958 |
| CA | 633295 | 12/1961 |
| CA | 903285 | 6/1972 |
| CA | 1043065 | 11/1978 |
| CA | 1043379 | 11/1978 |
| CA | 1047561 | 1/1979 |
| CA | 1063747 | 10/1979 |
| CA | 1069147 | 1/1980 |
| CA | 1072142 | 2/1980 |
| CA | 1138912 | 1/1983 |
| CA | 1145371 | 4/1983 |
| CA | 1147767 | 6/1983 |
| CA | 1151693 | 8/1983 |
| CA | 1180728 | 1/1985 |
| CA | 1183883 | 3/1985 |
| CA | 1187525 | 5/1985 |
| CA | 1205835 | 6/1986 |
| CA | 1206309 | 6/1986 |
| CA | 1206497 | 6/1986 |
| CA | 1207350 | 7/1986 |
| CA | 1219886 | 3/1987 |
| CA | 1230898 | 12/1987 |
| CA | 2071859 | 6/1991 |
| CA | 2029109 | 5/1992 |
| CA | 2037273 | 8/1992 |
| CA | 2066476 | 10/1992 |
| CA | 1310674 | 11/1992 |
| CA | 2071022 | 12/1992 |
| CA | 2062635 | 9/1993 |
| CA | 2067087 | 10/1993 |
| CA | 1328892 | 4/1994 |
| CA | 2081439 | 4/1994 |
| CA | 2088899 | 8/1994 |
| CA | 2120809 | 10/1994 |
| CA | 2099853 | 2/1995 |
| CA | 2108069 | 4/1995 |
| CA | 2105797 | 5/1995 |
| CA | 2132567 | 7/1995 |
| CA | 2123248 | 10/1995 |
| CA | 2125343 | 12/1995 |
| CA | 2204021 A1 | 5/1996 |
| CA | 2169216 | 8/1996 |
| CA | 2162444 | 12/1996 |
| CA | 2226670 A1 | 2/1997 |
| CA | 2160731 | 4/1997 |
| CA | 2164188 | 5/1997 |
| CA | 2200663 | 9/1997 |
| CA | 2180893 | 1/1998 |
| CA | 2238291 | 2/1998 |
| CA | 2190431 | 5/1998 |
| CA | 2096304 | 8/1998 |

| | | | |
|---|---|---|---|
| CA | 2228104 | | 9/1998 |
| CA | 2294864 | A1 | 9/1998 |
| CA | 2202454 | | 10/1998 |
| CA | 2223098 | | 12/1998 |
| CA | 2086470 | | 2/1999 |
| CA | 2244610 | | 2/1999 |
| CA | 2262210 | | 8/1999 |
| CA | 2333034 | A1 | 11/1999 |
| CA | 2272497 | | 12/1999 |
| CA | 2294301 | A1 | 1/2000 |
| CA | 2310802 | A1 | 2/2001 |
| CA | 2289988 | | 5/2001 |
| CA | 2326966 | A1 | 6/2001 |
| CA | 2329228 | A1 | 6/2001 |
| CA | 2293950 | A1 | 7/2001 |
| CA | 2324063 | A1 | 2/2002 |
| CA | 2357331 | A1 | 3/2002 |
| CA | 2359410 | A1 | 4/2002 |
| DE | 376009 | | 12/1921 |
| DE | 3238117 | A1 | 6/1983 |
| EP | 0 172 564 | A2 | 2/1986 |
| EP | 0 226 420 | A2 | 6/1987 |
| EP | 0 172 564 | A3 | 10/1987 |
| EP | 0 226 420 | A3 | 3/1988 |
| EP | 0 310 203 | A1 | 4/1989 |
| EP | 0 351 201 | A2 | 1/1990 |
| EP | 0 441 971 | A1 | 8/1991 |
| EP | 0 441 971 | B2 | 8/1991 |
| EP | 0 407 996 | A2 | 1/1992 |
| EP | 0 407 996 | A3 | 1/1992 |
| EP | 0 226 420 | B1 | 8/1992 |
| EP | 0 523 913 | A1 | 1/1993 |
| EP | 0 532 444 | A1 | 3/1993 |
| EP | 0 585 965 | A1 | 3/1994 |
| EP | 0 597 166 | A2 | 5/1994 |
| EP | 0 407 996 | B1 | 12/1994 |
| EP | 0 597 166 | A3 | 2/1995 |
| EP | 0 662 391 | A2 | 7/1995 |
| EP | 0 662 391 | A3 | 11/1995 |
| EP | 0 441 971 | B1 | 2/1996 |
| EP | 0 523 913 | B1 | 4/1996 |
| EP | 0 733 469 | A2 | 9/1996 |
| EP | 0 733 469 | B1 | 9/1996 |
| EP | 0 733 469 | A3 | 11/1996 |
| EP | 0 742 266 | A2 | 11/1996 |
| EP | 0 597 166 | B1 | 3/1997 |
| EP | 0 764 453 | A1 | 3/1997 |
| EP | 0 487 549 | B1 | 9/1997 |
| EP | 0 504 230 | B1 | 7/1998 |
| EP | 0 742 266 | A3 | 1/1999 |
| EP | 0 927 628 | A1 | 7/1999 |
| EP | 0 947 562 | A1 | 10/1999 |
| EP | 0 970 708 | A1 | 1/2000 |
| EP | 0 693 944 | B1 | 4/2000 |
| EP | 1 068 884 | A2 | 1/2001 |
| EP | 1 086 724 | A1 | 3/2001 |
| FI | 65018 | | 11/1983 |
| GB | 637779 | | 5/1950 |
| GB | 1121051 | | 7/1968 |
| SE | 169928 | | 12/1959 |
| WO | WO 82/03789 | | 11/1982 |
| WO | WO 91/08803 | | 6/1991 |
| WO | WO 91/16955 | | 11/1991 |
| WO | WO 90/15712 | | 12/1991 |
| WO | WO 93/05219 | | 3/1993 |
| WO | WO 94/21334 | | 9/1994 |
| WO | WO 94/23768 | | 10/1994 |
| WO | WO 95/01820 | | 1/1995 |
| WO | WO 95/24245 | | 9/1995 |
| WO | WO 96/01137 | | 1/1996 |
| WO | WO 96/01699 | | 1/1996 |
| WO | WO 96/02385 | | 2/1996 |
| WO | WO 96/13549 | | 5/1996 |
| WO | WO 97/03730 | | 2/1997 |
| WO | WO 97/03820 | | 2/1997 |
| WO | WO 97/29808 | | 8/1997 |
| WO | WO 97/33660 | | 9/1997 |
| WO | WO 97/41929 | | 11/1997 |
| WO | WO 98/01189 | | 1/1998 |
| WO | WO 98/19753 | | 5/1998 |
| WO | WO 98/24616 | | 6/1998 |
| WO | WO 98/41292 | | 9/1998 |
| WO | WO 98/55182 | | 12/1998 |
| WO | WO 99/17845 | | 4/1999 |
| WO | WO 99/32198 | | 7/1999 |
| WO | WO 99/60030 | | 11/1999 |
| WO | WO 00/03769 | | 1/2000 |
| WO | WO 00/09222 | | 2/2000 |
| WO | WO 00/10655 | | 3/2000 |
| WO | WO 00/27632 | | 5/2000 |
| WO | WO 00/32278 | | 6/2000 |
| WO | WO 00/46255 | A1 | 8/2000 |
| WO | WO 01/14019 | A1 | 3/2001 |
| WO | WO 01/26752 | A1 | 4/2001 |
| WO | WO 01/43838 | A1 | 6/2001 |
| WO | WO 01/47605 | A2 | 7/2001 |
| WO | WO 01/97990 | A2 | 12/2001 |
| WO | WO 02/04078 | A1 | 1/2002 |
| WO | WO 02/13638 | A2 | 2/2002 |
| WO | WO 02/35184 | A2 | 5/2002 |
| WO | WO 02/070080 | A1 | 9/2002 |
| WO | WO 02/089926 | A1 | 11/2002 |
| WO | WO 2005/082470 | A1 | 9/2005 |

OTHER PUBLICATIONS

The Rubber Group Materials, Aug. 31, 2004, 4 pages from website.

* cited by examiner

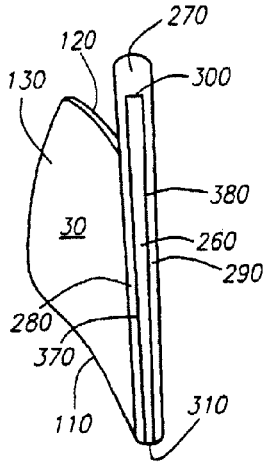
FIG. 4
FIG. 9
FIG. 3
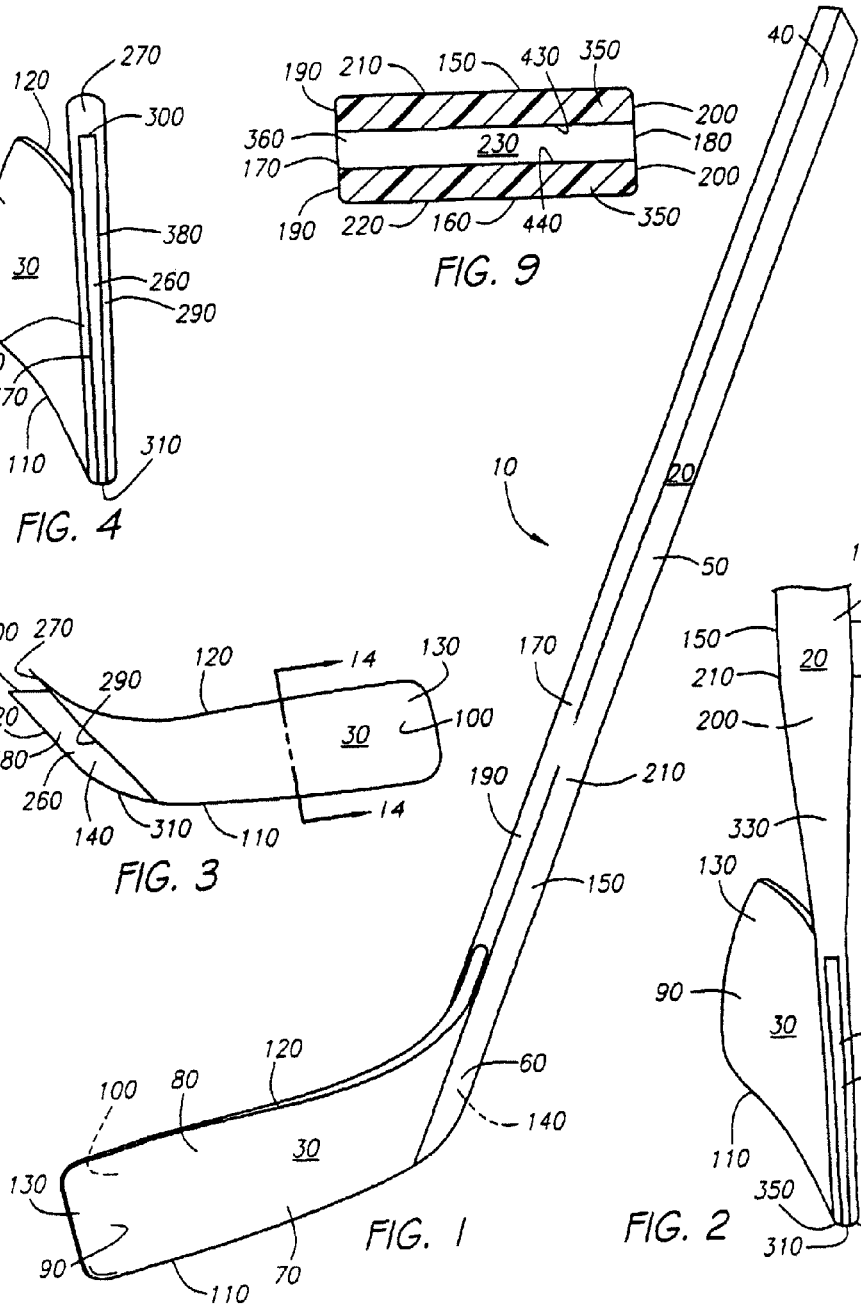
FIG. 1
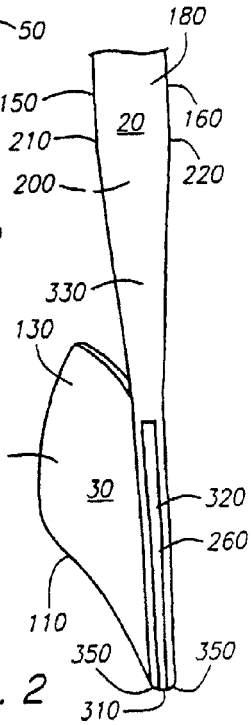
FIG. 2

300
340
290
120
14
130
320
260
30
100
140
250
110
14

300
120
130
30
260
290
280
240
250
110

10
20
40
50
180
200
150
20
160
170
190
210
330
320
340
150
130
90
30
260
110

120
100
80
60
140
30
130
90
110
70

FIG. 11
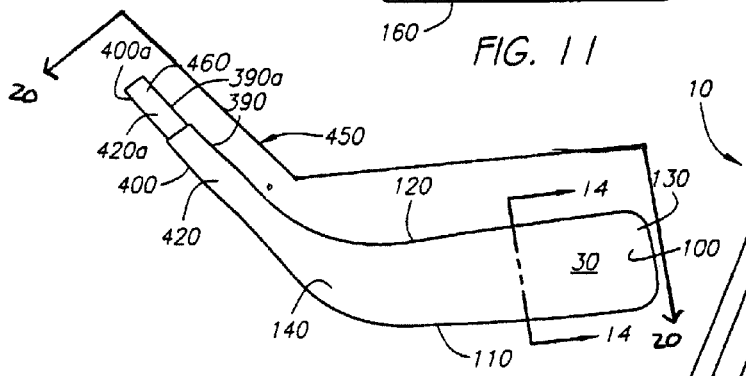
FIG. 13
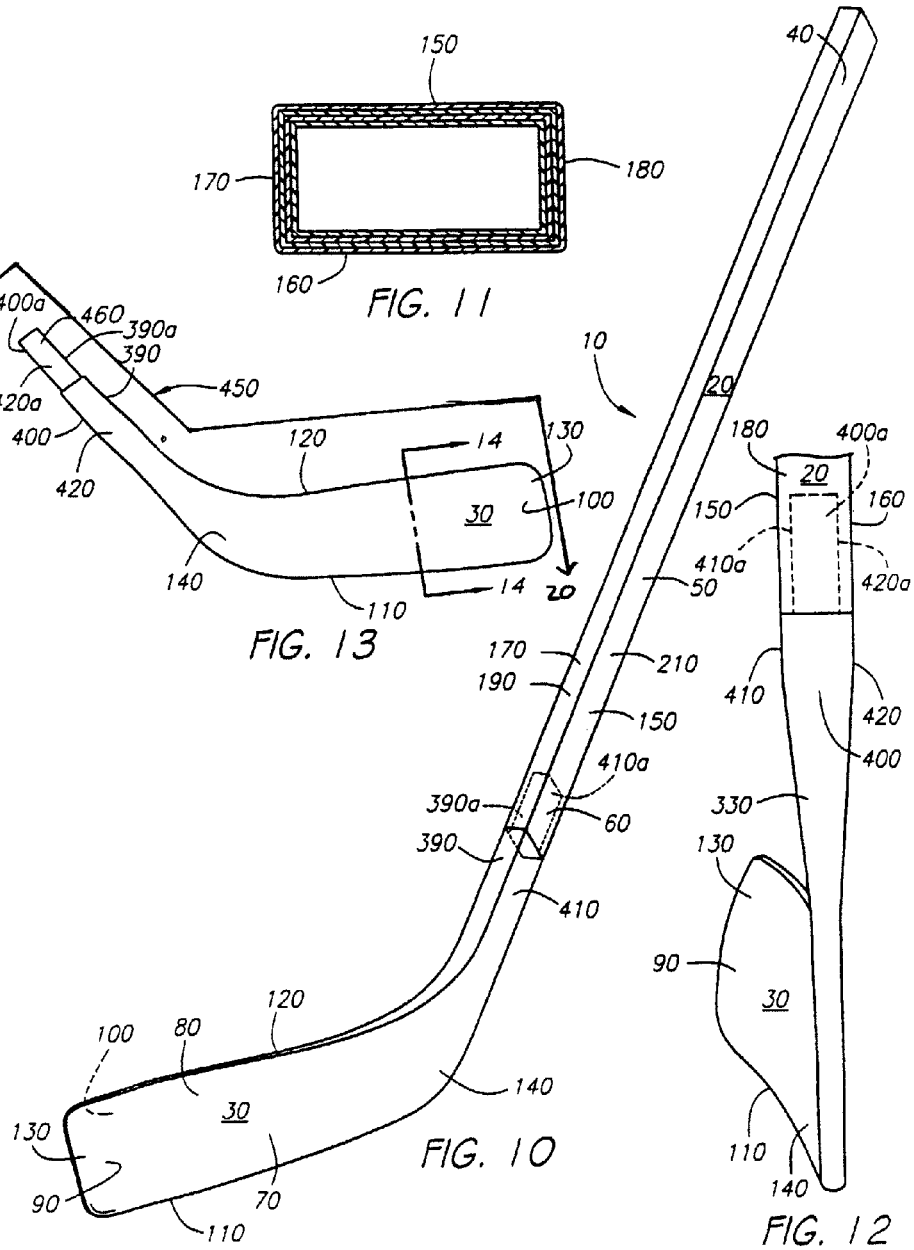
FIG. 10
FIG. 12

| | | |
|---|---|---|
| FIG. 16A | FIG. 16B | FIG. 16C |

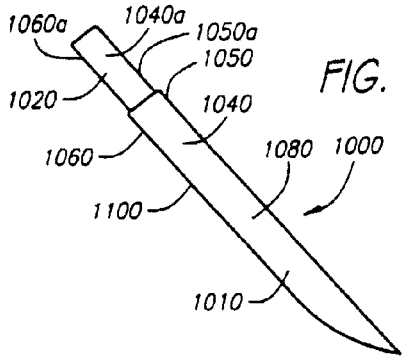
FIG. 17A
FIG. 17C
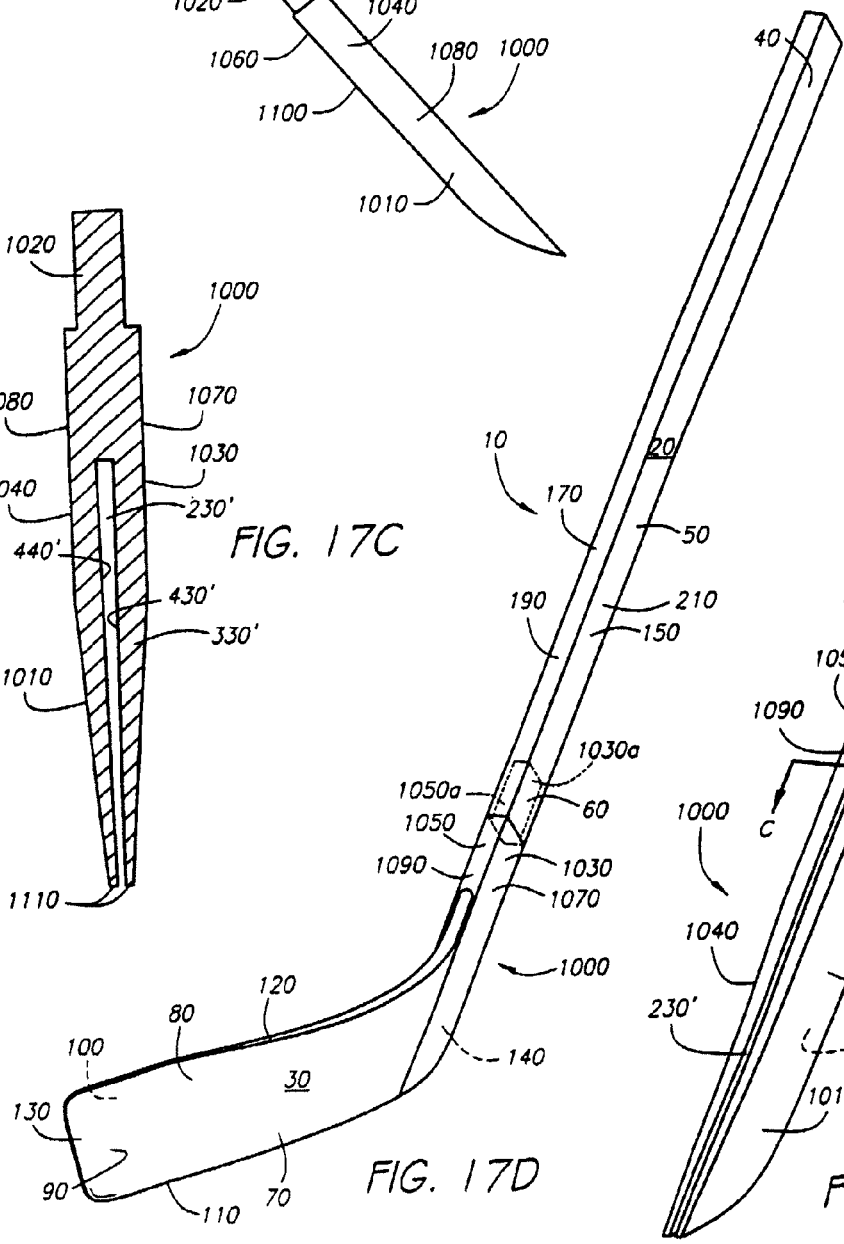
FIG. 17D
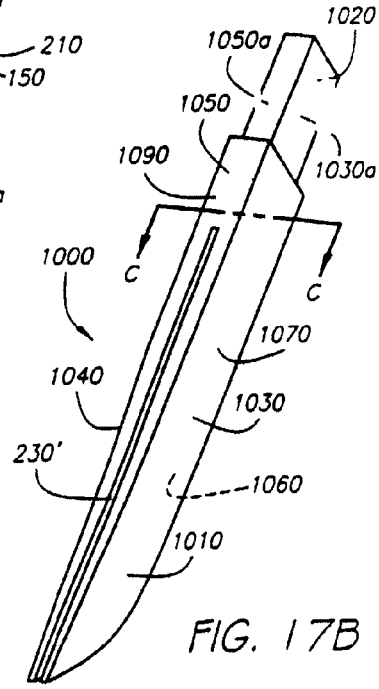
FIG. 17B

HOCKEY STICK

PRIORITY CLAIM

This application is a Continuation of U.S. patent application Ser. No. 10/439,652, filed May 15, 2003, and now pending, and which is a Continuation-in-part of U.S. patent application Ser. No. 10/290,052, filed on Nov. 6, 2002, now abandoned, which is a Continuation of U.S. patent application Ser. No. 09/663,598, filed on Sep. 15, 2000, now abandoned. This application is a Continuation of U.S. patent application Ser. No. 10/439,652, filed May 15, 2003, and now pending, which claims priority to U.S. Provisional Application No. 60/380,900, filed on May 15, 2002, and to U.S. Provisional Application No. 60/418,067, filed on Oct. 11, 2002. All of these applications are hereby incorporated by reference.

FIELD OF THE INVENTION

The field of the present invention generally relates to hockey sticks and component structures, configurations, and combinations thereof.

BACKGROUND

Generally, hockey sticks are comprised of a blade portion and an elongated shaft portion. Traditionally, each portion was constructed of wood (e.g., solid wood, wood laminates) and attached together at a permanent joint. The joint generally comprised a slot formed by two opposing sides of the lower end section of the shaft with the slot opening on the forward facing surface of the shaft. As used in this application "forward facing surface of the shaft" means the surface of the shaft that faces generally toward the tip of the blade and is generally perpendicular to the longitudinal length of the blade at the point of attachment. The heel of the blade comprised a recessed portion dimensioned to be receivable within the slot. Upon insertion of the blade into the slot, the opposing sides of the shaft that form the slot overlap the recessed portion of the blade at the heel. The joint was made permanent by application of a suitable bonding material or glue between the shaft and the blade. In addition, the joint was oftentimes further strengthened by an overlay of fiberglass material.

Traditional wood hockey stick constructions, however, are expensive to manufacture due to the cost of suitable wood and the manufacturing processes employed. In addition, due to the wood construction, the weight may be considerable. Moreover, wood sticks lacked durability, often due to fractures in the blade, thus requiring frequent replacement. Furthermore, due to the variables relating to wood construction and manufacturing techniques, wood sticks were often difficult to manufacture to consistent tolerances. For example, the curve and flex of the blade often varied even within the same model and brand of stick. Consequently, a player after becoming accustomed to a particular wood stick was often without a comfortably seamless replacement when the stick was no longer in a useable condition.

Notwithstanding, the "feel" of traditional wood-constructed hockey sticks was found desirable by many players. The "feel" of a hockey stick can vary depending on a myriad of objective and subjective factors including the type of construction materials employed, the structure of the components, the dimensions of the components, the rigidity or bending stiffness of the shaft and/or blade, the weight and balance of the shaft and/or blade, the rigidity and strength of the joint(s) connecting the shaft to the blade, the curvature of the blade, the sound that is made when the blade strikes the puck, etc. Experienced players and the public are often inclined to use hockey sticks that have a "feel" that is comfortable yet provides the desired performance. Moreover, the subjective nature inherent in this decision often results in one hockey player preferring a certain "feel" of a particular hockey stick while another hockey player prefers the "feel" of another hockey stick.

Perhaps due to the deficiencies relating to traditional wood hockey stick constructions, contemporary hockey stick design veered away from the traditional permanently attached blade configuration toward a replaceable blade and shaft configuration, wherein the blade portion was configured to include a connection member, often referred to as a "tennon", "shank" or "hosel", which generally comprised of an upward extension of the blade from the heel. The shafts of these contemporary designs generally were configured to include a four-sided tubular member having a connection portion comprising a socket (e.g., the hollow at the end of the tubular shaft) appropriately configured or otherwise dimensioned so that it may slidably and snugly receive the connection member of the blade. Hence, the resulting joint generally comprised a four-plane lap joint. In order to facilitate the detachable connection between the blade and the shaft and to further strengthen the integrity of the joint, a suitable bonding material or glue is typically employed. Notable in these contemporary replaceable blade and shaft configurations is that the point of attachment between the blade and the shaft is substantially elevated relative to the heel attachment employed in traditional wood type constructions.

Contemporary replaceable blades, of the type discussed above, are constructed of various materials including wood, wood laminates, wood laminate overlain with fiberglass, and what is often referred to in the industry as "composite" constructions. Such composite blade constructions employ what is generally referred to as a structural sandwich construction, which comprises a low-density rigid core faced on generally opposed front and back facing surfaces with a thin, high strength, skin or facing. The skin or facing is typically comprised of plies of woven and substantially continuous fibers, such as carbon, glass, graphite, or Kevlar™ disposed within a hardened matrix resin material. Of particular importance in this type of construction is that the core is strongly or firmly attached to the facings and is formed of a material composition that, when so attached, rigidly holds and separates the opposing faces. The improvement in strength and stiffness, relative to the weight of the structure, that is achievable by virtue of such structural sandwich constructions has found wide appeal in the industry and is widely employed by hockey stick blade manufacturers.

Contemporary composite blades are typically manufactured by employment of a resin transfer molding (RTM) process, which generally involves the following steps. First, a plurality of inner core elements composed of compressed foam, such as those made of polyurethane, are individually and together inserted into one or more woven-fiber sleeves to form an uncured blade assembly. The uncured blade assembly, including the hosel or connection member, is then inserted into a mold having the desired exterior shape of the blade. After the mold is sealed, a suitable matrix material or resin is injected into the mold to impregnate the woven-fiber sleeves. The blade assembly is then cured for a requisite time and temperature, removed from the mold, and finished. The curing of the resin serves to encapsulate the fibers within a rigid surface layer and hence facilitates the transfer of load among the fibers, thereby improving the strength of the surface layer. In addition, the curing process serves to attach the rigid foam core to the opposing faces of the blade to create—at least initially—the rigid structural sandwich construction.

Experience has shown that considerable manufacturing costs are expended on the woven-fiber sleeve materials themselves, and in impregnating those fiber sleeves with resin while the uncured blade assembly is in the mold. Moreover, the process of managing resin flow to impregnate the various fiber sleeves, has been found to, represent a potential source of manufacturing inconsistency.

Composite blades, nonetheless, are thought to have certain advantages over wood blades. For example, composite blades may be more readily manufactured to consistent tolerances and are generally more durable than wood blades. In addition, due to the strength that may be achieved via the employment of composite structural-sandwich construction, the blades may be made thinner and lighter than wood blades of similar strength and flexibility.

Although capable of having considerable load strength relative to weight, experience has shown that such constructions nevertheless also produce a "feel" and/or performance attributes that are unappealing to some players. Even players that choose to play with composite hockey sticks continually seek out alternative sticks having improved feel or performance. Moreover, despite the advent of contemporary composite blade constructions and two-piece replaceable blade-shaft configurations, traditional wood-constructed hockey sticks are still preferred by many players notwithstanding the drawbacks noted above.

SUMMARY

The present invention relates to hockey sticks, their configurations and their component structures. Various aspects are set forth below.

In one aspect, a hockey stick blade comprises one or more inner core elements surrounded by one or more layers of reinforcing fibers or filaments disposed in a hardened matrix resin material. One or more of the inner core elements or components is comprised of one or more elastomer materials such as silicone rubber. The one or more elastomer inner core materials may be positioned in discrete zones in the blade to effect performance or the physical properties of the blade. For example, one or more inner cores comprising an elastomer material may be positioned in or adjacent to a designated intended impact zone, about or adjacent to the length of a portion of the circumference of the blade, and/or along or adjacent a vibration pathway to the shaft, such as in the hosel section.

In another aspect, a hockey stick blade is comprised of multiple inner core elements and an outer wall made of or otherwise comprising reinforcing fibers or filaments disposed in a hardened matrix resin. At least two of the inner core elements are made of different elastomer materials.

In yet another aspect, a hockey stick blade is comprised of multiple inner core elements and an outer wall made of reinforcing fibers or filaments disposed in a hardened matrix resin. At least one of the inner core elements is an elastomer material and at least another of the inner core elements is non-elastomer material such as a foam, a hardened resin, or a fiber or filament reinforced matrix resin.

In yet another aspect, a blade for a hockey stick includes an inner core comprising a non-elastomer material such as a hardened resin or a fiber or filament reinforced matrix resin material, surrounded on one or more sides by an elastomer material, such as silicone rubber. The elastomer material may comprise the outer surfaces of the blade, or may be overlain by one or more additional layers of non-elastomer material, such as fiber or filament reinforced matrix resin, thereby forming a blade having an elastomer material sandwiched between a non-elastomer core and a non-elastomer outer wall.

Hence, in yet another aspect, a blade for a hockey stick comprises multiple inner core elements or components made or otherwise comprised of an elastomer material, wherein the elastomer inner core elements are spaced apart in various configurations with a non-elastomer material such as a foam, a hardened resin, or a fiber or filament reinforced matrix resin residing between the elastomer core elements.

In yet another aspect, mechanical and/or physical properties are employed to further characterize elastomer materials employed in the composite blade constructs disclosed.

Yet another aspect is directed to a procedure and apparatus for measuring the coefficient of restitution of a material such as an elastomer inner core material.

In yet another aspect, the elastomer materials employed as core elements of a composite blade fall within a group of elastomer materials that maintain elastomer properties even after they are subjected to subsequent heating that occurs during the molding (e.g., such as the resin transfer molding ("RTM") process) of an uncured blade assembly comprising an inner core made of the elastomer material.

Yet another aspect is directed to preferred relative dimensions of the elastomer components to other blade components in terms of relative cross-sectional areas and blade thickness.

In yet another aspect, an adapter member is disclosed which is configured to attach the hockey stick blade to the hockey stick shaft. In yet another aspect, the adapter member includes one or more inner core elements comprised of an elastomer material.

In yet another aspect, a composite hockey stick blade made in accordance with one or more of the foregoing aspects is configured for connection with various configurations of a shaft to form a hockey stick. Hence, the composite blade may be configured to connect directly to the shaft or indirectly via an adapter member configured to join the blade with the shaft. The connection to the shaft or adapter member may be configured in a manner so that it is located at the heel, as in a traditional wood constructed hockey stick. Alternatively, the connection to the shaft may be above the heel as in contemporary two-piece hockey stick configurations. In yet another aspect, the attachment or connection between the composite blade and the shaft, whether indirect or direct, may be detachable or permanent.

In yet another aspect, a hockey stick comprises a shaft made, in part or in whole, of wood or wood laminate, and a composite blade made in accordance with one or more of the foregoing aspects.

Yet another aspect is directed to the manufacture of a hockey stick comprising a shaft and a composite blade constructed in accordance with one or more of the foregoing aspects and in accordance with one or more of the various hockey stick configurations and constructions disclosed herein, wherein the process of manufacturing the blade or adapter member includes the steps of forming an uncured blade or adapter assembly with one or more layers of resin pre-impregnated fibers or filaments and one or more other components such as a foam or elastomer inner core, placing the uncured blade assembly in a mold configured to impart the shape of the blade or adapter member; sealing the mold over the uncured blade or adapter member assembly, applying heat to the mold to cure the blade or adapter member assembly; and removing the cured blade or adapter member assembly from the mold.

In yet another aspect is directed to a hockey stick comprising a shaft and a composite blade constructed in accordance with one or more of the foregoing aspects and in accordance with one or more of the various hockey stick configurations disclosed herein.

In yet another aspect, a hockey stick is comprised of a shaft and a composite blade, wherein the hockey stick is constructed in accordance with one or more of the foregoing aspects.

Additional implementations, features, variations, and advantages of the invention will be set forth in the description that follows, and will be further evident from the illustrations set forth in the accompanying drawings.

BRIEF DESCRIPTION OF THE DRAWINGS

The accompanying drawings illustrate presently contemplated embodiments and constructions of the invention and, together with the description, serve to explain various principles of the invention.

FIG. 1 is a diagram illustrating a first hockey stick configuration.

FIG. 2 is a rear view of a lower portion of the hockey stick illustrated in FIG. 1

FIG. 3 is a back face view of the hockey stick blade illustrated in FIG. 1 detached from the hockey stick shaft.

FIG. 4 is a rear end view of the hockey stick blade illustrated in FIG. 3.

FIG. 9 is a bottom end view of the hockey stick shaft illustrated in FIGS. 1 and 5 detached from the blade.

FIG. 10 is a diagram illustrating a third hockey stick configuration.

FIG. 11 is a bottom end view of the hockey stick shaft illustrated in FIGS. 10 and 12 detached from the blade.

FIG. 12 is a rear view of a lower portion of the hockey stick illustrated in FIG. 10.

FIG. 13 is a back face view of the hockey stick blade illustrated in FIG. 10 detached from the hockey stick shaft.

FIG. 17A is a side view of an adapter member employed in a fourth hockey stick configuration illustrated in FIG. 17D; the adapter is configured to join a hockey stick blade, such as the type illustrated in FIGS. 3 and 7, to a hockey stick shaft, such as is illustrated in FIGS. 10-12.

FIG. 17B is a perspective view of the adapter member illustrated in FIG. 17A.

FIG. 17C is a cross-sectional view of the adapter member illustrated in FIGS. 17A and 17B.

FIG. 17D is a diagram illustrating a fourth hockey stick configuration employing the adapter member illustrated in FIGS. 17A-17C.

DETAILED DESCRIPTION OF THE PREFERRED EMBODIMENTS

Figures 5, 6, 7, 8:
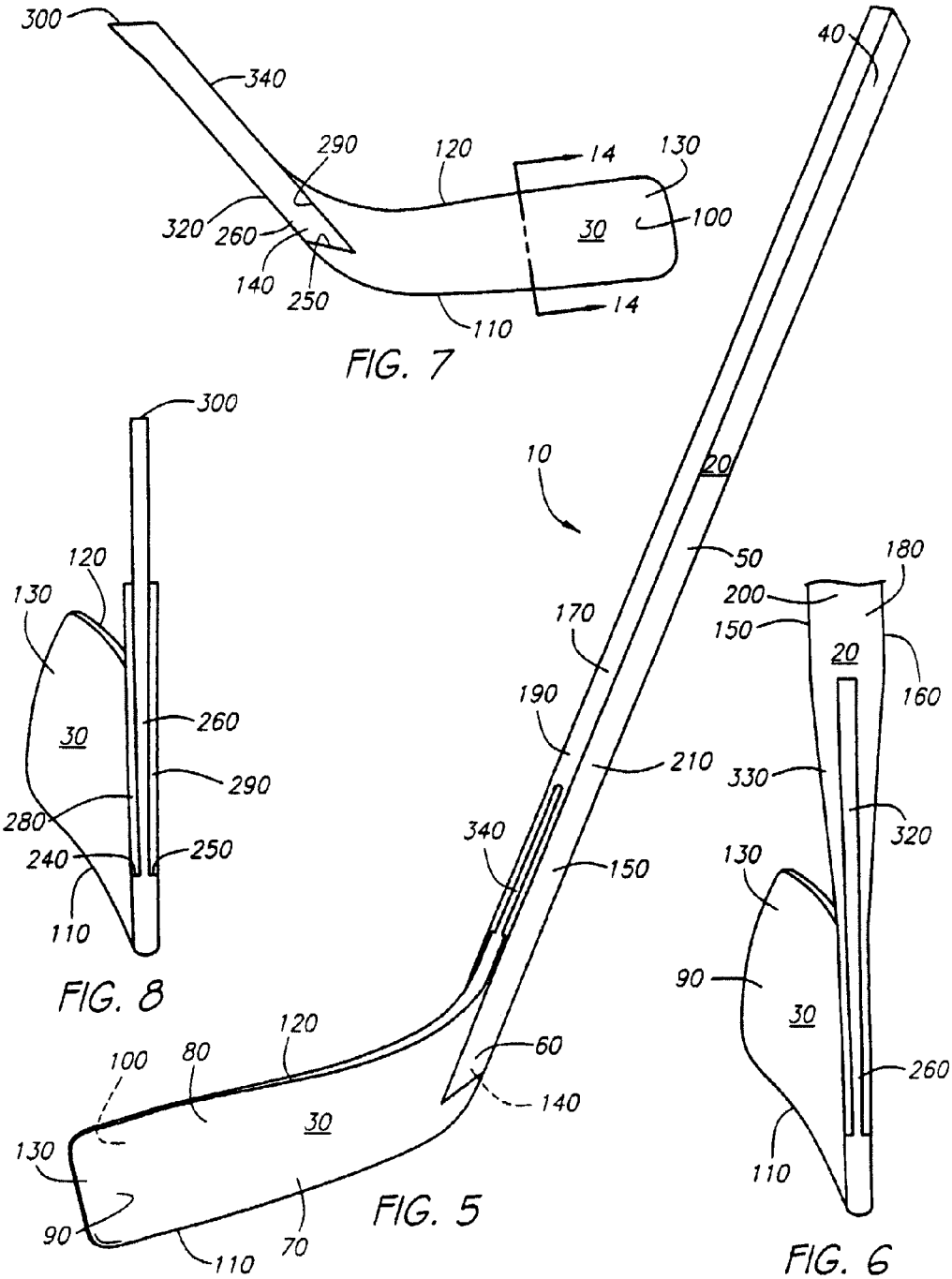
FIG. 5 is a diagram illustrating a second hockey stick configuration.
FIG. 6 is a rear view of a lower portion of the hockey stick illustrated in FIG. 5.
FIG. 7 is a back face view of the hockey stick blade illustrated in FIG. 5 detached from the hockey stick shaft.
FIG. 8 is a rear end view of the hockey stick blade illustrated in FIG. 7.

The preferred embodiments will now be described with reference to the drawings. To facilitate description, any reference numeral designating an element in one figure will designate the same element if used in any other figure. The following description of the preferred embodiments is only exemplary. The present invention(s) is not limited to these embodiments, but may be realized by other implementations. Furthermore, in describing preferred embodiments, specific terminology is resorted to for the sake of clarity. However, the invention is not intended to be limited to the specific terms so selected, and it is to be understood that each specific term includes all equivalents.

Hockey Stick Configurations

FIGS. 1-13 and 17 are diagrams illustrating first, second, third, and fourth hockey stick 10 configurations. Commonly shown in FIGS. 1-13 and 17 is a hockey stick 10 comprised of a shaft 20 and a blade 30. The blade 30 comprises a lower section 70, an upper section 80, a front face 90, a back face 100, a bottom edge 110, a top edge 120, a tip section 130, and a heel section 140. In the preferred embodiment, the heel section 140 generally resides between the plane defined by the top edge 120 and the plane defined by the bottom edge 110 of the blade 30. The shaft 20 comprises an upper section 40, a mid-section 50, and a lower section 60. The lower section 60 is adapted to be joined to the blade 30 or, with respect to the fourth hockey stick configuration illustrated in FIGS. 17A-D, the adapter member 1000.

The shaft 20 is preferably generally rectangular in cross-section with two wide opposed walls 150 and 160 and two narrow opposed walls 170 and 180. Narrow wall 170 includes a forward-facing surface 190 and narrow wall 180 includes a rearward-facing surface 200. The forward-facing surface 190 faces generally toward the tip section 130 of the blade 30 and is generally perpendicular to the longitudinal length (i.e., the length between the heel section 140 and the tip section 130) of the blade 30. The rearward-facing surface 200 faces generally away from the tip section 130 of the blade 30 and is also generally perpendicular to the longitudinal length of the blade 30. Wide wall 150 includes a front-facing surface 210 and wide wall 160 includes a back-facing surface 220. When the shaft 20 is attached to the blade 30, the front-facing surface 210 faces generally in the same direction as the front face 90 of the blade 30 and the back-facing surface 220 faces generally in the same direction as the back face 100 of the blade 30.

In the first and second hockey stick configurations illustrated in FIGS. 1-9, the shaft 20 includes a tapered section 330 having a reduced shaft width. The "shaft width" is defined for the purposes of this application as the dimension between the front and back facing surfaces 210 and 220. The tapered section 330 is preferably dimensioned so that when the shaft 20 is joined to the blade 30 the front and back facing surfaces 210, 220 of the shaft 20 are generally flush with the adjacent portions of the front and back faces 90 and 100 of the blade 30. The lower section 60 of the shaft 20 includes an open-ended slot 230 (best illustrated in FIG. 9) that extends from the forward-facing surface 190 of narrow wall 170 preferably, although not necessarily, through the rearward-facing surface 200 of narrow wall 180. As best illustrated in FIG. 9, the slot 230 also, but not necessarily, extends through the end surface 350 of the shaft 20. The slot 230 is dimensioned to receive, preferably slidably, a recessed or tongue portion 260 located at the heel section 140 of the blade 30.

As best illustrated in FIGS. 3-4 and 7-8, the transition between the tongue portion 260 and an adjacent portion of the blade 30 extending toward the tip section 130 forms a frontside shoulder 280 and a back-side shoulder 290, each of which generally face away from the tip section 130 of the blade 30. When the tongue portion 260 is joined to the shaft 20 via the slot 230 the forward facing surface 190 of the shaft 20 on either side of the slot 230 opposes and preferably abuts with shoulders 280 and 290. Thus, the joint formed is similar to an open slot mortise and tongue joint. The joint may be made permanent by use of adhesive such as epoxy, polyester, methacrolates (e.g., Plexus™) or any other suitable material. However, Plexus™ has been found to be suitable for this application. In addition, as in the traditional wood construction, the joint may be additionally strengthened after the blade 30 and shaft 20 are joined by an overlay of fiberglass or other suitable material over the shaft 20 and/or blade 30 or selected portions thereof.

As illustrated in FIGS. 1-4 and 9 of the first hockey stick configuration, the tongue portion 260 comprises an upper edge 300, a lower edge 310, and a rearward-facing edge 320. The blade 30 preferably includes an upper shoulder 270 that extends from the upper edge 300 of the tongue portion 260 upwardly away from the heel section 140. When the tongue portion 260 is joined within the slot 230, the forward-facing surface 190 of the shaft 200 located directly above the top of the slot 230 opposes and preferably abuts with the upper shoulder 270 of the blade 30; the rearward-facing edge 320 of the tongue 260 is preferably flush with the rearward-facing surface 200 of the shaft 20 on either side of the slot 230; the lower edge 310 of the tongue 260 is preferably flush with the end surface 350 of the shaft 20; the upper edge 300 of the tongue 260 opposes and preferably abuts with the top surface 360 of the slot 230; and the front and back side surfaces 370, 380 of the tongue 260 oppose and preferably abut with the inner sides 430, 440 of the wide opposed walls 150, 160 that define the slot 230.

As illustrated in FIGS. 5-9 of the second hockey stick configuration, the tongue portion 260 extends upwardly from the heel section 140 beyond the top edge 120 of the blade 30 and is comprised of an upper edge 300, a rearward-facing edge 320, and a forward-facing edge 340. The blade 30 includes a second set of front and back-side shoulders 240 and 250 that border the bottom of the tongue 260 and preferably face generally upwardly, away from the bottom edge 110 of the blade 30. When the tongue portion 260 is received within the slot 230, the end surface 350 of the shaft 20 on either side of the slot opposes and preferably abuts with shoulders 240 and 250; the rearward-facing edge 320 of the tongue 260 is preferably flush with the rearward-facing surface 200 of the shaft 20 on either side of the slot 230; the forward-facing edge 340 of the tongue 260 is preferably flush with the forward-facing surface 190 of the shaft 20 on either side of the slot 230; the upper edge 300 of the tongue 260 opposes and preferably abuts with the top surface 360 of the slot 230; and the front and back side surfaces 370, 380 of the tongue 260 oppose and preferably abut with the inner sides 430, 440 of the wide opposed walls 150, 160 that define the slot 230.

Illustrated in FIGS. 10-13 is a third hockey stick 10 configuration. As best shown in FIG. 11 the shaft 20 is preferably comprised of a hollow tubular member preferably having a generally rectangular cross-sectional area throughout the longitudinal length of the shaft 20. The blade 30 includes an extended member or hosel portion 450 preferably comprised of two sets of opposed walls 390, 400 and 410, 420 and a mating section 460. The mating section 460 in a preferred embodiment is comprised of a rectangular cross section (also having two sets of opposed walls 390*a*, 400*a*, and 410*a*, 420*a*) that is adapted to mate with the lower section 60 of the shaft 20 in a four-plane lap joint along the inside of walls 150, 160, 170, and 180. The outside diameter of the rectangular cross-sectional area of the mating section 460 is preferably dimensioned to make a sliding and snug fit inside the hollow center of the lower section 60 of the shaft 20. Preferably, the blade 30 and shaft 20 are bonded together at the four-plane lap joint using an adhesive capable of removably cementing the blade 30 to the shaft 20. Such adhesives are commonly known and employed in the industry and include Z-Waxx™ manufactured by Easton Sports and hot melt glues. Alternatively, it is also contemplated that the joint between blade 30 and shaft 20 be made permanent by use of an appropriate adhesive.

Illustrated in FIG. 17A-D is a fourth hockey stick 10 configuration, which generally comprises the blade 30 illustrated in FIG. 3, the shaft 20 illustrated in FIGS. 10-12, and an adapter member 1000 best illustrated in FIGS. 17A-C. The adapter member 1000 is configured at a first end section 1010 to receive the tongue 260 of the blade 30 illustrated and previously described in relation to FIGS. 3 and 7. A second end section 1020 of the adapter member 1000 is configured to be connectable to a shaft. In the preferred embodiment, the second end section 1020 is configured to be receivable in the hollow of the shaft 20 illustrated and previously described in relation to FIGS. 10-12. In particular, the adapter member 1000 is comprised of first and second wide opposed walls 1030, 1040 and first and second narrow opposed walls 1050, 1060. The first wide opposed wall 1030 includes a front facing surface 1070 and the second wide opposed wall includes a back facing surface 1080, such that when the adapter member 1000 is joined to the blade 30, the front facing surface 1070 generally faces in the same direction as the front face 90 of the blade 30 and the back facing surface 1080 generally faces in the same direction as the back face 100 of the blade 30. The first narrow opposed wall 1050 includes forward facing surface 1090 and the second narrow opposed wall 1060 includes a rearward facing surface 1100, such that when the adapter member 1000 is joined to the blade 30, the forward facing surface 1090 generally faces toward the tip section 130 of the blade and is generally perpendicular to the longitudinal length of the blade 30 (i.e., the length of the blade from the tip section 130 to the heel section 140), and the rearward facing surface 1100 generally faces away from the tip section 130 of the blade 30.

The adapter member 1000 further includes a tapered section 330' having a reduced width between the front and back facing surfaces 1070 and 1080. The tapered section 330' is preferably dimensioned so that when the adapter member 1000 is joined to the blade 30, the front and back facing surfaces 1070, 1080 are generally flush with the adjacent portions of the front and back faces 90 and 100 of the blade 30.

The first end section 1010 includes an open-ended slot 230' that extends from the forward facing surface 1090 of narrow wall 1050 preferably, although not necessarily, through the rearward facing surface 1100 of narrow wall 1060. The slot 230' also preferably, but not necessarily, extends through the end surface 1110 of the adapter member 1000. The slot 230' is dimensioned to receive, preferably slidably, the recessed tongue portion 260 located at the heel section 140 of the blade 30 illustrated in FIGS. 3 and 7.

As previously discussed in relation to the shaft illustrated in FIGS. 1-2 and 5-6, when the slot 230' is joined to the tongue portion 260, the forward facing surface 1090 on either side of the slot 230' opposes and preferably abuts the front and back side shoulders 280, 290 of the blade 30 to form a joint similar to an open slot mortise and tongue joint. In addition, the rearward-facing edge 320 of the tongue 260 is preferably flush with the rearward facing surface 1100 of the adapter member 1000 on either side of the slot 230'; the upper edge 300 of the tongue 260 opposes and preferably abuts with the top surface 360' of the slot 230'; and the front and back side surfaces 370, 380 of the tongue 260 oppose and preferably abut with the inner sides 430', 440' of the wide opposed walls 1030 and 1040 of the adapter member 1000.

Moreover, when joined to the blade 30 configuration illustrated in FIG. 3, the end surface 1110 of the adapter member 1000 on either side of the slot 230' is preferably flush with the lower edge 310 of the tongue 260. Alternatively, when joined to the blade 30 configuration illustrated in FIG. 7, the end surface 1110 of the adapter member 1000 on either side of the slot 230' opposes and preferably abuts shoulders 240 and 250 and the forward facing edge 340 of the tongue 260 is preferably flush with the forward facing surface 1090 of the adapter member 1000 on either side of the slot 230'.

The second end section 1020 of the adapter member 1000, as previously stated, is preferably configured to be receivable in the hollow of the shaft 20 previously described and illustrated in relation to FIGS. 10-12, and includes substantially the same configuration as the mating section 460 described in relation to FIGS. 10-13. In particular, the second end section 1020 in a preferred embodiment is comprised of a rectangular cross section having two sets of opposed walls 1030*a*, 1040*a* and 1050*a*, 1060*a* that are adapted to mate with the lower section 60 of the shaft 20 in a four-plane lap joint along the inside of walls 150, 160, 170, and 180 (best illustrated in FIG. 11). The outside diameter of the rectangular cross-sectional area of the second end section 1020 is preferably dimensioned to make a sliding fit inside the hollow center of the lower section 60 of the shaft 20. Preferably, the adapter member 1000 and shaft 20 are bonded together at the four-plane lap joint using an adhesive capable of removably cementing the adapter member 1000 to the shaft 20 as previously discussed in relation to FIGS. 10-13.

It is to be understood that the adapter member 1000 may be comprised of various materials, including the composite type constructions discussed below (i.e., substantially continuous fibers disposed within a resin and wrapped about one or more core materials described herein), and may also be constructed of wood or wood laminate, or wood or wood laminate overlain with outer protective material such as fiberglass. It is noted that when constructed of wood, a player may obtain the desired wood construction "feel" while retaining the performance of a composite blade construction since the adapter member 1000 joining the blade and the shaft would be comprised of wood. Thus, it is contemplated that performance attributes, such as flexibility, vibration, weight, strength and resilience, of the adapter member 1000 may be adjusted via adjustments in structural configuration (e.g., varying dimensions) and/or via the selection of construction materials including employment of the various core materials described herein.

Hockey Stick Blade Constructions

FIGS. 14A through 14K are cross-sectional views taken along line 14-14 of FIGS. 3, 7, and 13 illustrating construction configurations of the hockey stick blade 30. It is to be understood that the configurations illustrated therein are exemplary and various aspects, such as core configurations or other internal structural configurations, illustrated or described in relation to the various constructions, may be combined or otherwise modified to facilitate particular design purposes or performance criteria. FIGS. 14A through 14J and 18A-B illustrate constructions that employ one or more inner core elements 500 overlain with one or more layers 510 comprising one or more plies 520 of substantially reinforcing fibers or filaments disposed in a hardened matrix resin. The reinforcing fibers or filaments may be substantially continuous.

Figure 14A:
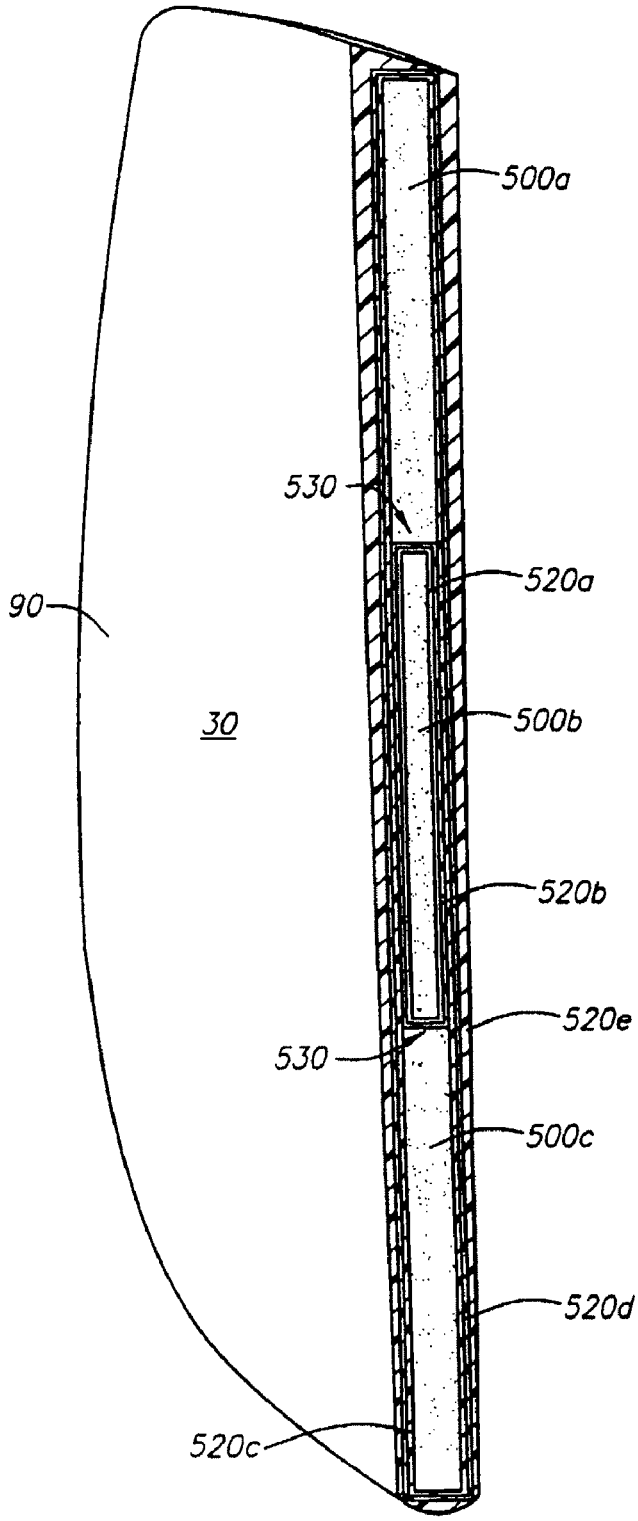
FIG. 14A is a cross-sectional view taken along line 14-14 of FIGS. 3, 7, and 13 illustrating a first alternative construction of the hockey stick blade.
Figure 14B:
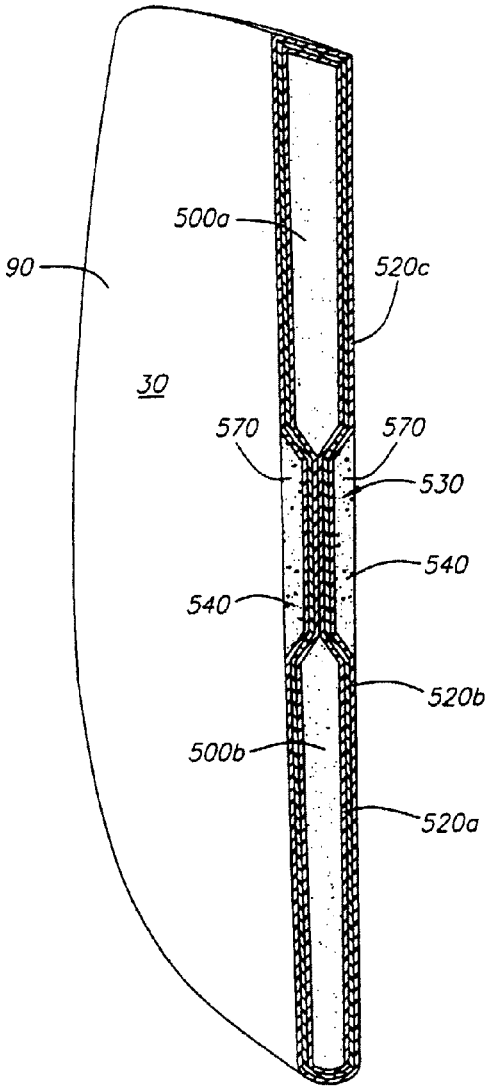
FIG. 14B is a cross-sectional view taken along line 14-14 of FIGS. 3, 7, and 13 illustrating a second alternative construction of the hockey stick blade.
Figure 14C:
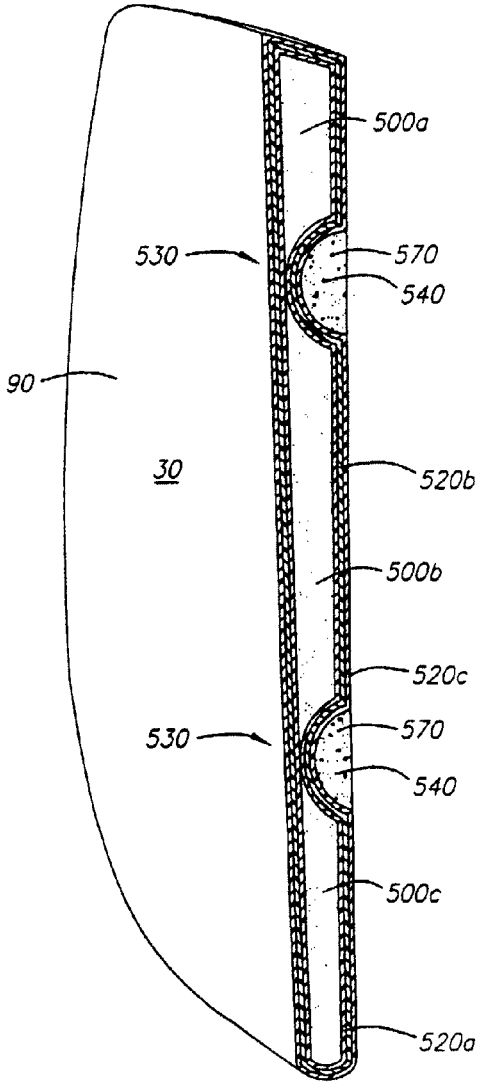
FIG. 14C is a cross-sectional view taken along line 14-14 of FIGS. 3, 7 and 13 illustrating a third alternative construction of the hockey stick blade.
Figure 14D:
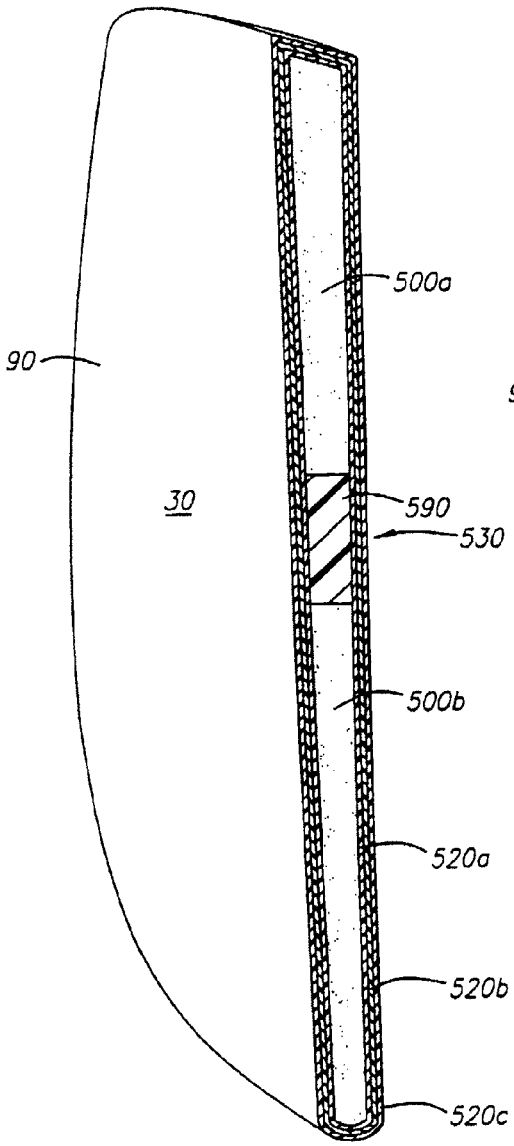
FIG. 14D is a cross-sectional view taken along line 14-14 of FIGS. 3, 7 and 13 illustrating a fourth alternative construction of the hockey stick blade.
Figure 14F:
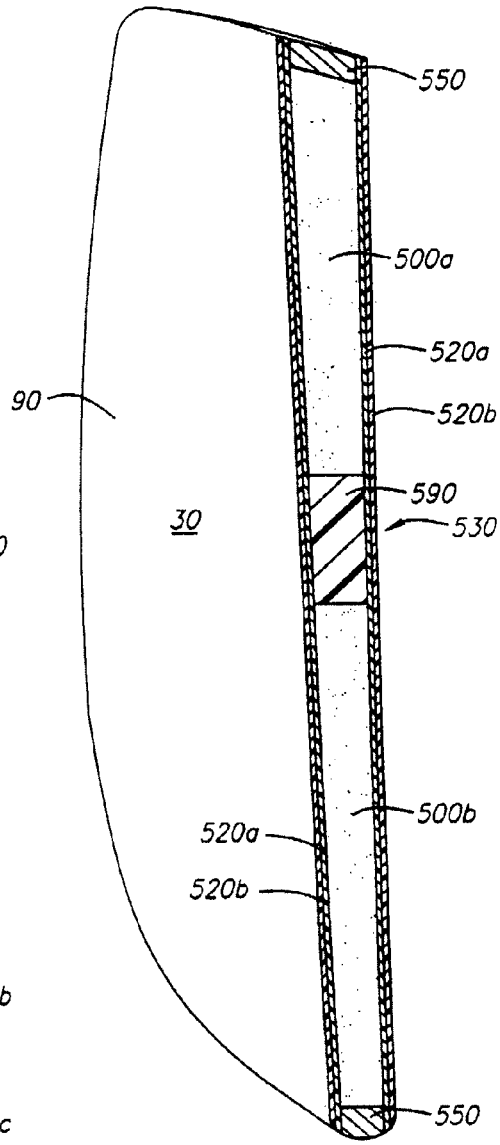
FIG. 14F is a cross-sectional view taken along line 14-14 of FIGS. 3, 7 and 13 illustrating a sixth alternative construction of the hockey stick blade.
Figure 14E:
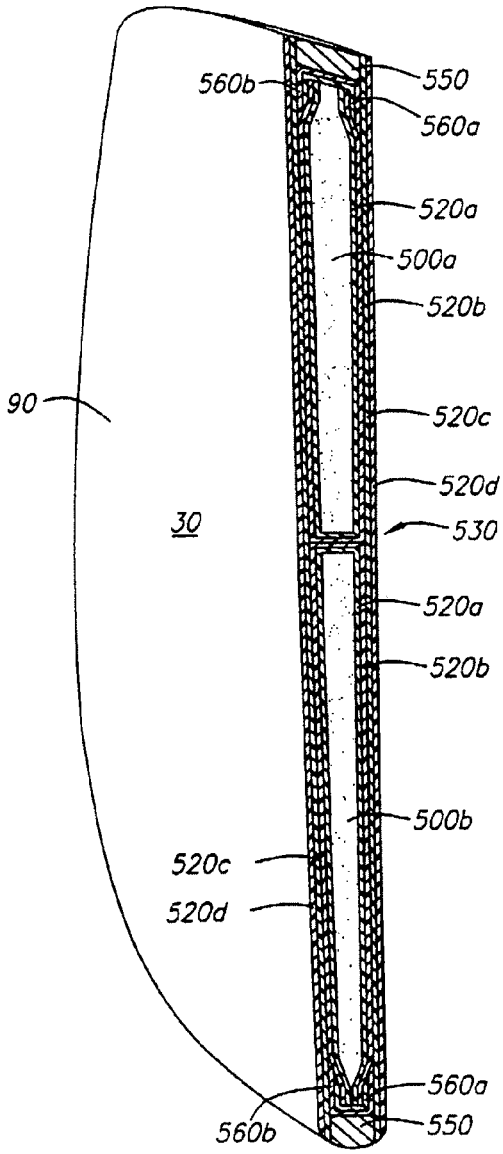
FIG. 14E is a cross-sectional view taken along line 14-14 of FIGS. 3, 7 and 13 illustrating a fifth alternative construction of the hockey stick blade.
Figure 14K:
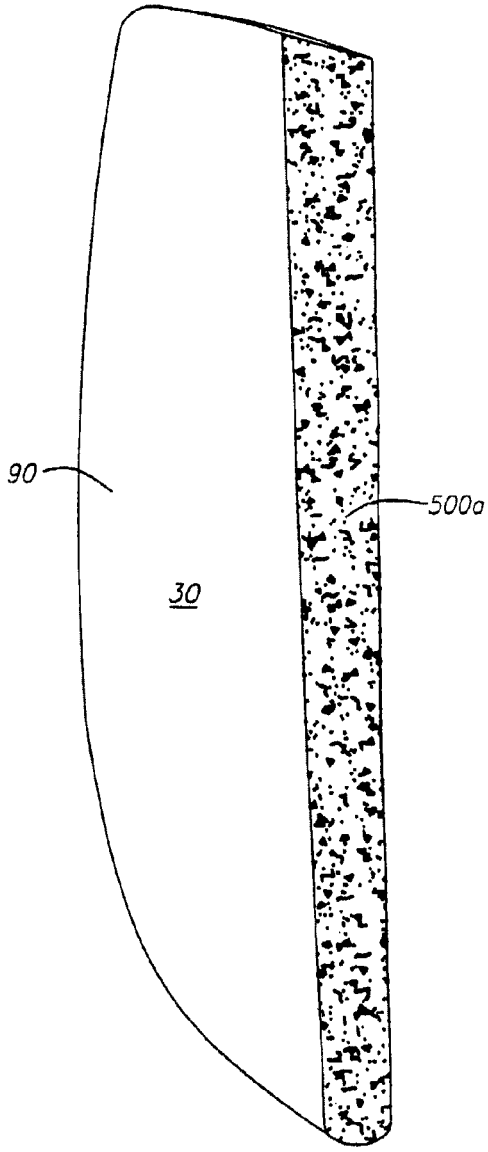
FIG. 14K is a cross-sectional view taken along line 14-14 of FIGS. 3, 7 and 13 illustrating an eleventh alternative construction of the hockey stick blade or core component thereof.
Figure 14G:
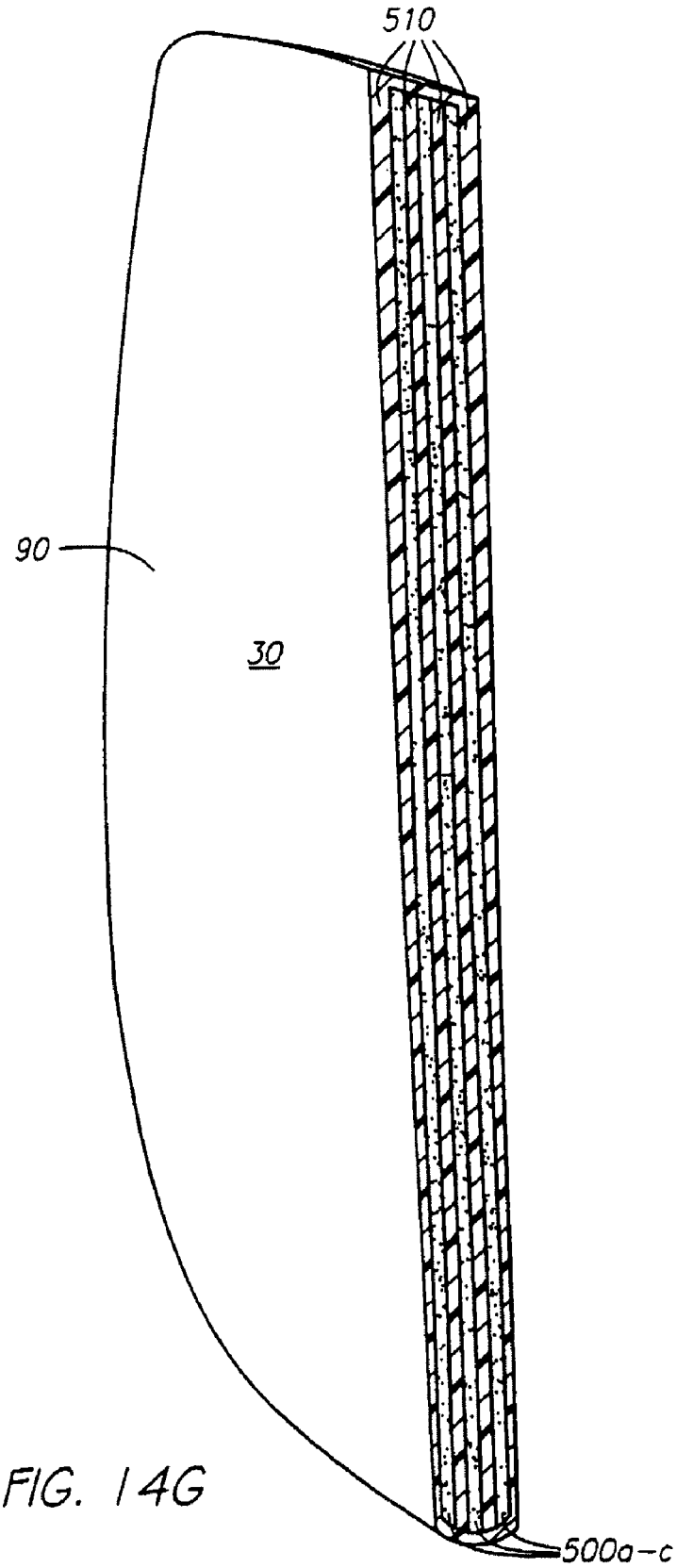
FIG. 14G is a cross-sectional view taken along line 14-14 of FIGS. 3, 7 and 13 illustrating a seventh alternative construction of the hockey stick blade.

FIG. 14K illustrates yet another alternative blade construction or core component construction comprising non-continuous fibers disposed in a matrix or resin base (often referred to as bulk molding compound ("BMC"). FIGS. 15A and 16A-16C are flow charts detailing preferred steps of manufacturing the blade constructions illustrated in FIGS. 14A-14J and 18A-B. FIG. 15B is a flow chart detailing preferred steps of manufacturing the blade or core component construction illustrated in FIG. 14K.

It is to be understood that the dimensions of the hockey sticks and the blades thereof disclosed herein may vary depending on specific design criteria. Notwithstanding, it contemplated that the preferred embodiments are capable of being manufactured so as to comply with the design criteria set forth in the official National Hockey League Rules (e.g., Rule 19) and/or the 2002 National Collegiate Athletic Association ("NCAA") Men's and Women's Ice Hockey Rules (e.g. Rule 3). Hence, it is contemplated that the hockey stick and blade constructions and configurations disclosed herein are applicable to both forward and goaltender sticks.

Commonly shown in FIGS. 14A-14J and 18A-18B are one or more inner core elements identified as 500*a*-500*c* (identified as elements 1500 in FIG. 18A-B, and 1510 in FIG. 18B), one or more layers 510 (identified as elements 1500 in FIG. 18A-B, and 1520 in FIG. 18B) comprising one or more plies identified as 520*a*-520*d* of substantially continuous fibers disposed in a hardened matrix or resin based material. Also commonly shown in FIGS. 14A-14F and 14I-14J are one or more internal bridge structures commonly identified by call out reference numeral 530, which extend generally in a direction that is transverse to the front and back faces 90, 100 of the blade 30. Prior to setting forth a detailed discussion of each of these alternative constructions, a discussion of the construction materials employed is set forth.

Construction Materials

The hockey stick blades 30 illustrated in the exemplary constructions of FIGS. 14A-14K and 18A-B generally comprises one or more core elements (e.g., element 500) and one or more exterior plies (e.g., element 520) reinforcing fibers or filaments disposed in a hardened matrix resin material. Presently contemplated construction materials for each of these elements are described below.

Core Materials

Depending on the desired performance or feel that is sought, the inner core elements 500 may comprise various materials or combinations of various materials. For example, a foam core element may be employed in combination with an "elastomer" (i.e., elastomer) core and/or a core made of discontinuous or continuous fibers disposed in a resin matrix.

Foam: Foam cores such as those comprising formulations of expanding syntactic or non-syntactic foam such as polyurethane, PVC, or epoxy have been found to make suitable inner core elements for composite blade construction. Such foams typically have a relatively low density and may expand during heating to provide pressure to facilitate the molding process. Furthermore, when cured such foams are amenable to attaching strongly to the outer adjacent plies to create a rigid structural sandwich construction, which are widely employed in the industry. Applicants have found that polyurethane foam, manufactured by Burton Corporation of San Diego, Calif. is suitable for such applications.

Perhaps due to their limited elasticity, however, such foam materials have been found amenable to denting or being crushed upon singular or repetitive impact, such as that which occurs when a puck is shot. Because the inner cores of conventional hockey stick structures are essentially totally comprised of foam, compromise in the durability and/or the consistent performance of the blade structure with time and use may occur.

Elastomer or Rubber: The employment of elastomers, or rubbery materials, as significant core elements in hockey sticks, as described herein, is novel in the composite hockey stick industry. The term "elastomer" or "elastomeric", as used herein, is defined as, or refers to, a material having properties similar to those of vulcanized natural rubber, namely, the ability to be stretched to approximately twice its original length and to retract rapidly to approximately its original length when released and includes the following materials:

(1) vulcanized natural rubber;

(2) synthetic thermosetting high polymers such as styrene-butadiene copolymer, polychloroprene (neoprene), nitrile rubber, butyl rubber, polysulfide rubber ("Thiokol"), cis-1,4-polyisoprene, ethylene-propylene terpolymers (EPDM rubber), silicone rubber, and polyurethane rubber, which can be cross-linked with sulfur, peroxides, or similar agents to control elasticity characteristics; and (3) Thermoplastic elastomers including polyolefins or TPO rubbers, polyester elastomers such as those marketed under the trade name "Hytrel" by E. I. Du Pont; ionomer resins such as those marketed under the tradename "Surlyn" by E.I. Du Pont, and cyclic monomer elastomers such as di-cyclo pentadiene (DCPD).

Notably, composite structures employing elastomer cores, as a general principle, do not follow the classic formulas for calculating sandwich loads and deflections. This is so because these materials are elastic and therefore are less amenable to forming a rigid internal structure with the exterior skin or plies of the sandwich. Consequently, it is no surprise that composite hockey stick structures (e.g., composite blades) comprising elastomer cores are absent from the industry. Notwithstanding, applicants have found that the employment of such elastomer cores individually or in combination with other core materials, such as foam, are capable of providing desirable feel and/or performance characteristics.

For example, the sound that is generated when a hockey puck is struck by a hockey stick can be modified with the employment of such elastomer cores to produce a uniquely pleasing sound to the player as opposed to the "hollow-pingy" type sound that is typically created with traditional composite hockey sticks. Further, the resilient elasticity of elastomers make them suited to the unique dynamics endured by hockey stick blades and components. Unlike conventional foam core materials, elastomer cores can be chosen such that their coefficients of restitution (CORs) are comparable to wood, yet by virtue of their resilient properties are capable of withstanding repetitive impact and thereby provide consistent performance and suitable durability.

Moreover, employment of elastomer core materials have been found to impact or dampen the significance of the vibration typically produced from a traditional foam core composite blade and thereby provide a manner of controlling or tuning the vibration to a desired or more desirable feel.

In addition, because elastomers are available with significant ranges in such mechanical properties as elasticity, resilience, elongation percentage, density, hardness, etc. they are amenable to being employed to achieve particular product performance criteria. For example, an elastomer may have properties that are suitable for providing both a desired coefficient of restitution while at the same time suitable for achieving the desired vibration dampening or sound. Alternatively, a combination of clastomers may be employed to achieve the desired performance attributes, perhaps one more suited for dampening while the other being better suited for attaining the desired coefficient of restitution. Thus, it has been found that the use of elastomer cores can facilitate unique control or modification over performance criteria.

Figure 20:
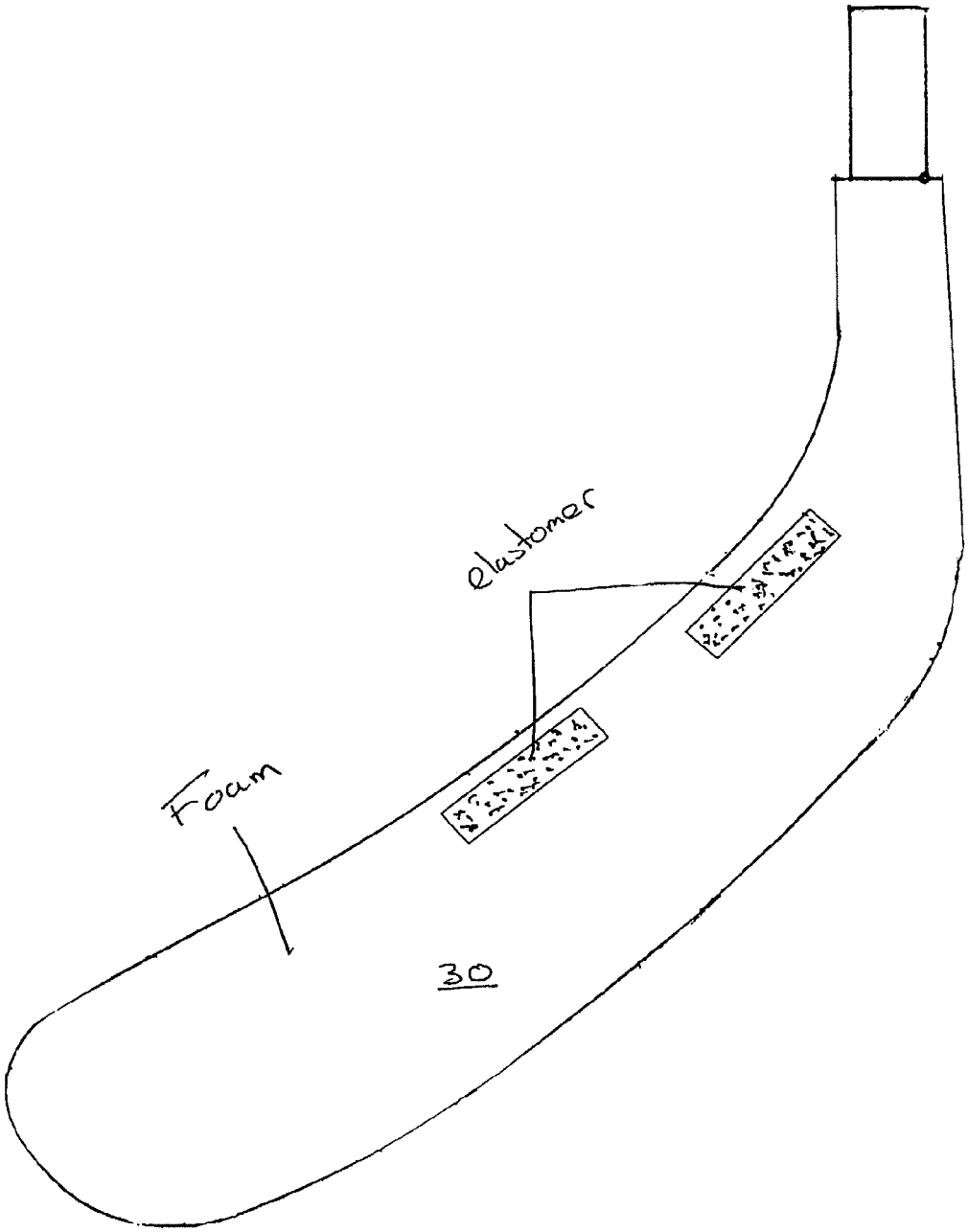
FIG. 20 is a cross-sectional view of the hockey stick blade generally illustrated in FIGS. 10-13 taken along line 20-20 of FIG. 13 and depicts an exemplary construction of the hockey stick blade, the shaded areas represent areas of the core that are formed of an elastomer material while the un-shaded portions of the core represent areas of the core that are formed of foam.

Moreover, it is to be understood that the elastomer may be employed in a limited capacity and need not constitute the totality, or even a majority, of the core. This is especially significant in that elastomer materials typically have densities significantly greater than conventional foam core materials, and hence may significantly add to the overall weight of the blade and the hockey stick. Thus, for example, it may be preferable that elastomer materials be placed in discrete strategic locations—such as in and/or around a defined impact zone of the blade, along the outer circumference of the blade, or along vibration transmission pathways perhaps in the hosel, heel or along the edge of the blade. They may be placed in vertical and/or horizontal lengths within the core at spaced intervals. For example, reference is made to FIG. 20, shown therein is a cross-sectional diagram of the hockey stick blade taken generally longitudinally along the plane of the hockey stick blade 30 as identified by line 20-20 in FIG. 13. The elastomer core components are identified by shading and the foam core components are identified as the portions of the core that are not shaded. Moreover, it is to be understood that dimensions (e.g., thickness, height, width) of one or more of the core materials, whether an elastomer or otherwise, may be varied relative to the external blade 30 dimensions, or relative to other internal blade components or structures. Thus, for example it is contemplated that the thickness of the core may be thinner at the tip section 130 and along the upper edge 120 than at regions more proximate to the heel region 140 and the bottom or lower edge 110. Thus for example in FIG. 20 it is contemplated that the thickness of the more distally positioned elastomer core element is generally thinner than the more proximately positioned elastomer core element. The foam core element interposed between the distally and proximately positioned elastomer core element would have a thickness dimension generally in between those of the adjacent elastomer core elements.

Furthermore, it is to be understood that elastomer materials may be combined in discrete layers and/or sections with more traditional core structures (e.g., foam, wood, or wood laminate) and/or other materials such as plastics, or other fiber composite structures, such as a material comprised of continuous or discontinuous fibers or filaments disposed in a matrix resin. In addition, it is also contemplated that combinations of core materials may be blended or otherwise mixed.

Preferred Characterizations and Implementations of Elastomeric Materials

Preferred characterizations of elastomer materials and preferred implementations of elastomer cores and structures are set forth in the following paragraphs. It is to be understood that each of the following characterizations and/or implementations may be employed independently from or in combination with one or more of the other preferred characterizations and/or implementations to further define the preferred hockey stick and blade configurations, embodiments, and constructions.

First Preferred Characterization: A first preferred characterization of the materials that fall within the definition of "elastomer" as used and described herein include materials that have a ratio of the specific gravity ("SG") to the coefficient of restitution ("COR") less than or equal to five (5.0), as described by the formula set forth below:

$$SG+COR \leqq 5.0$$

Figure 19A:
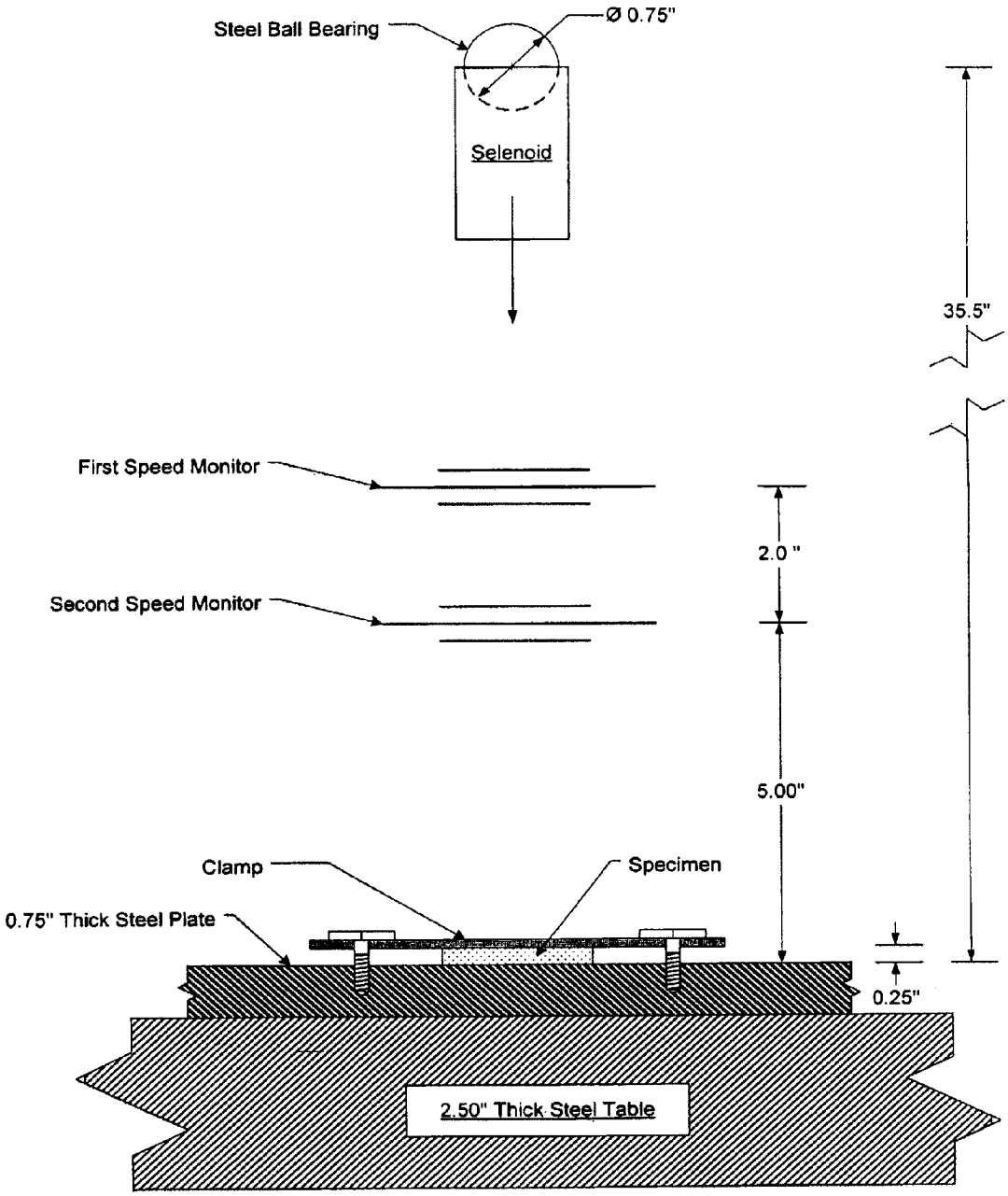
FIGS. 19A-B are diagrams of the apparatus employed for testing and measuring performance characteristics of core materials and blade constructs as described herein.
Figure 19B:
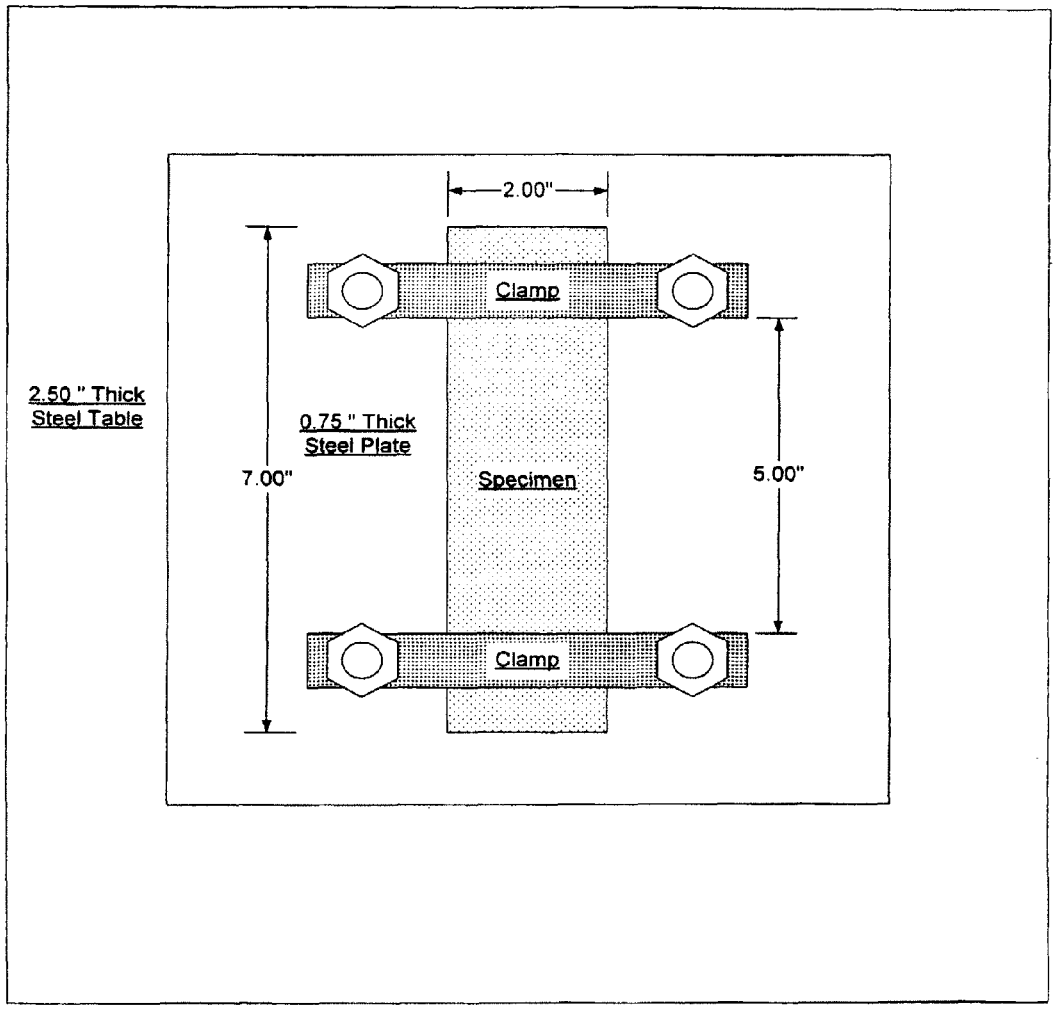

Where:

SG: is the ratio of the weight or mass of a given volume of any substance to that of an equal volume of water at four degrees Celsius; and COR: also known as the "restitution coefficient", can vary from 0 to 1 and is generally the relative velocity of two bodies of mass after impact to that before impact as further described by the "Coefficient of Restitution Test" procedure and apparatus set forth below and illustrated in FIGS. 19A-B.

"Coefficient of Restitution Test": The foregoing "Coefficient of Restitution Test" procedure is novel in the hockey stick industry. The test procedure is similar in some aspects to ASTM Designation F 1887-98 entitled Standard Test Method for Measuring the Coefficient of Restitution (COR) of Baseballs and Softballs, which was published in February 1999. FIGS. 19A-B are illustrations of the testing apparatus. The procedure is intended to set forth the method of measuring the coefficient of restitution of core materials used in composite constructs, particularly hockey stick blades and component parts, as described herein. Further, the procedure is intended to establish a single, repeatable, and uniform test method for testing such core materials.

The test method is based on the velocity measurement of a steel ball bearing before and after impact of the test specimen. As defined herein, the "coefficient of restitution" (COR) is a numerical value determined by the exit speed of the steel ball bearing after contact divided by the incoming speed of the steel ball bearing before contact with the test specimen. The dimensions of the test specimen are 7+/−0.125×2+/−0.125×0.25+/−0.0625 inches. Notwithstanding the foregoing dimensional tolerances of the test specimens, it is to be understood that the specimens are to be prepared with dimensions that are as accurate as reasonably possible when employing this test procedure.

Once the test specimen is prepared, it is firmly secured to a massive, rigid, flat wall, which is comprised of a 0.75 inch-thick steel plate mounted on top of a 2.50 inch-thick steel table. The sample specimen is secured to the steel plate via clamps positioned at the ends of the specimen, approximately equal distance from the specimen's geometric center. The clamps should be sufficiently tightened to the steel plate over the specimen to be tested so as to inhibit the specimen from moving when impacted by the steel ball bearing. Clamp placement should be approximately 5.0 inches apart or 2.5 inches from the specimens center, which resides in the intended impact zone.

The steel ball bearing is made of 440 C grade steel and has a Rockwell hardness between C58-C65, a weight of 66.0 grams +/−0.25 grams, a sphericity of 0.0001 inches, and a diameter of 0.75 inches +/−0.0005 inches. See ASTM D 756 entitled Practice for Determination of Weight and Shape changes of Plastic Under Accelerated Service Conditions. Such spherical steel ball bearings meeting the foregoing criteria may be procured from McMaster Carr, USA or any other suitable or available source or vendor.

Electronic speed monitors measure the steel ball bearings' speed before and after impact with the test specimen. Each speed monitor is comprised of generally two components: (1) a vertical light screen and (2) a photoelectric sensor. The vertical light screens are mounted 2.0+/−0.125 inches apart, with the lower light screen being mounted 5+/−0.125 inches above the top surface of the 0.75 inch thick steel plate. Two photoelectric sensors, one located at each screen, trigger a timing device on the steel ball bearing passage thereby measuring the time for the ball to traverse the distance between the two vertical planes before and after impact with the test specimen. The resolution of the measuring apparatus shall be +/−0.03 m/s.

The test room shall be environmentally controlled having a temperature of 72° F. +/−6° F., a relative humidity of 50%+/−5%. Prior to testing, the specimens are to be conditioned by placing them for at least 12 hours in an environmentally controlled space having the same temperature and relative humidity as the test room.

The steel ball bearing shall be dropped from a height of 30.5 inches+/−0.2 inches. The ball shall be dropped 25 times on the specimen via the employment of a suitable release device, such as a solenoid. A minimum of a 45-second rest period is required between each drop. The average of the 25

COR values for each specimen is used to determine the COR of the specimen, in accordance with the following formulae:

$$COR=V_b/V_a=\tfrac{1}{25}[(V_{b1}/V_{a1})+(V_{b2}/V_{a2})+(V_{b3}-/V_{a3})\ldots+(V_{b23}/V_{a23})+(V_{b24}/V_{a24})+(V_{b25}V_{a25})]$$

Where:

$V_a$=incoming speed adjusted or compensated for the effects of gravity, and $V_b$=exit speed adjusted or compensated for the effects of gravity.

Data acquisition hardware such as that marketed under the trade name "Lab View" and data acquisition circuit boards may be obtained from National Instruments Corporation located in Austin, Tex., and suitable wiring from sensors to acquisition ports may be obtained from Keyence Corporation of America located in Torrance, Calif.

Second Preferred Characterization: A second preferred characterization of the materials that fall within the definition of "elastomeric" as used and described herein include materials that have an ultimate elongation equal to or greater than 100% in accordance with the following formula:

$$\text{Ultimate Elongation Percentage}=\{[(\text{final length at rupture})-(\text{original length})\div\text{original length}]\}\times 100$$

Where:

Ultimate Elongation: also referred to as the breaking elongation, is the elongation at which specimen rupture occurs in the application of continued tensile stress as measured in accordance with ASTM Designation D 412 Standard Test Methods for Vulcanized Rubber and Thermoplastic Elastomers—Tension (August 1998).

Third Preferred Characterization: A third preferred characterization of the materials that fall within the definition of "elastomer" as used and described herein include materials that are capable of undergoing a subsequent heating and pressure commensurate with curing and molding (e.g., such as the RTM process previously discussed or the process described in relation to FIGS. 15A and 16), yet still fall within the definition of an elastomer as defined herein. For example in a typical molding process such as that disclosed in relation to the process described in FIG. 15A, the blade assembly may be subject to a cure temperature between 200 and 350 degrees Fahrenheit for a period ranging from 10 to 20 minutes and commensurate pressure resulting therefrom. Hence, the third preferred characterization relates to employment of a material that can undergo such processing and still fall within the definition of an elastomer as described herein.

First Preferred Implementation: A first preferred implementation of an elastomer core material in a composite structure, such as a hockey stick blade, as used and described herein is defined by the ratio of the cross-sectional area comprising an elastomer core divided by the total cross sectional area, in accordance with the following formula:

$$A_E \div A_T \geqq 0.25$$

Where:

$A_E$: is the cumulative area at any given cross-section of the blade that is occupied by an elastomer; and $A_T$: is the total area at the same cross-section of the blade.

The foregoing preferred implementation is applicable to any cross-section of the blade 30 regardless of where along the blade that cross-section is taken. It is to be understood, however, that this preferred implementation employs a cross-sectional area that is generally perpendicular to the front and back faces 90, 100 of the blade 30 such as those illustrated in FIGS. 14A-14K and 18A-B.

Second Preferred Implementation: A second preferred implementation of an elastomer core in a composite structure, such as a hockey stick blade, as used and described herein is defined by the ratio of the thickness of the elastomer divided by the total thickness of the blade, in accordance with the following formula:

$$T_E T_T \geqq 0.25$$

Where:

$T_E$: is the cumulative thickness of all elastomer core materials at any given cross-sectional plane of the blade, as described above in relation to the first preferred implementation, and as measured along a line on that cross-sectional plane that is generally normal to one or both (i.e., at least one) of the faces 90, 100 of the blade 30 at the point where the line intersects the face; and $T_T$: is the total thickness of the blade as measured along the same line of measurement employed in the measurement of $T_E$.

Alternative First and Second Preferred Implementations: Alternative first and second preferred implementations of an elastomer core material in a composite structure, such as a hockey stick blade, as used and described herein is defined as set forth in the first and second preferred implementations described above in relation to equations (4) and (5), except that:

$A_T$: is defined as $A_T'$ and is no longer the total area at the cross-section of the blade but rather is the total area at the cross-section occupied by fibers or filaments disposed in a hardened matrix or resin material; and $T_T$: is defined as $T_T'$, and is no longer the total thickness of the blade as measured along the same line of measurement employed in the measurement of $T_E$, but rather is the total thickness of the layer(s) comprising fibers or filaments disposed in a hardened matrix or resin material as measured along the same line of measurement employed in the measurement of $T_E$.

Elastomer Core Testing and Related Data

Four elastomer core materials made of silicone rubber, which are identified in the following tables as M-1 to M-4, were prepared and the samples were subjected to COR comparison testing. The cores were compared to materials traditionally employed in conventional hockey stick blades, in particular wood, resin matrix, foam, and plastic. Table 1 is a compilation of that data.

TABLE 1

| Material Description | S.G. | Hardness [Shore A points] | Tensile Strength [psi] | Elongation [%] | Tear Strength Die B [lbs/inch] | COR | SG + COR |
|---|---|---|---|---|---|---|---|
| M-1 | 1.28 | 56 | 900 | 120 | 40 | 0.541 | 2.37 |
| M-2 | 1.15 | 5 | 436 | 731 | 110 | 0.590 | 1.95 |
| M-3 | 1.13 | 20 | 914 | 600 | 132 | 0.614 | 1.84 |
| M-4 | 1.11 | 40 | 525 | 225 | 100 | 0.635 | 1.75 |
| Wood (Ash) | 0.69 | | | | | 0.564 | 1.22 |
| Resin Matrix | 8.20 | | | | | 0.832 | 9.86 |
| Foam | 0.14 | | | | | —[1] | |
| Plastic | 1.01 | | | | | 0.667 | 1.51 |

[1]The steel ball bearing did not bounce-off the foam sample when it was tested for COR and therefore the COR measurement is negligible.

The values of specific gravity, hardness, tensile strength, elongation percentage and tear strength for the silicone rubber samples M-1 to M-4, were provided by the manufacturer and are understood to comply with ASTM measurement standards. Table 2 is a compilation of the trade names and manufacturers of the materials set forth above in Table 1.

TABLE 2

| Material | Description: Manufacturer | Description: Trade Name |
|---|---|---|
| M-1 | Dow Corning | Silastic J |
| M-2 | Dow Corning | HS IV RTV High Strength |
| M-3 | Dow Corning | Silastic S-2 RTV |
| M-4 | Circle K | GI-1040 TRV |
| Resin Matrix | Dow Chemical | D.E.R. 332 Epoxy Resin |
| Foam | Burton Corporations, San Diego, CA | BUC-500 Foam |
| Plastic | Generic | Acrylonitrile Butadine Styrene Resin ("ABS") |

As noted in Table 1, the specific gravity for each of the silicone rubber core materials M-1 to M-4 was significantly greater than the foam yet significantly less than the resin. In addition, the measured COR for each of the silicone rubber core materials were comparable to the COR measured for the wood specimen. Furthermore, the measured COR of the silicone rubber samples exhibited a generally linear increase with decreasing S. G. values.

Thin and thick walled composite hockey stick blade constructs were manufactured with cores made of each of the four silicone rubber samples as well as the foam sample. The thin and thick walled composite blades were manufactured using the same blade mold and generally in accordance with the procedure described in relation to FIG. 15A. It is to be understood the phrase thin and thick walled refers to the walls of the blade between which the core material is interposed. Hence a thick walled blade would be formed with a thicker layer of fibers disposed within a hardened resin matrix material than a thin walled blade.

The constructs were then subjected to comparative COR testing. The same test apparatus was employed as discussed in relation to the COR Test Procedure set forth above, except that the steel ball bearing used in the test had a weight of 222.3+/−0.25 grams, a sphericity of 0.0001 inches, and a diameter of 1.00+/−0.0005 inches. In addition, since the specimens were comprised of composite blade constructs, the specimen dimensions set forth in the COR Test Procedure set forth above also were different. Table 3 sets forth the COR data of these tests.

TABLE 3

| Material | Description: COR of Thin Blade Construct (tested) | Description: COR of Thick Blade Construct (tested) |
|---|---|---|
| M-1 | 0.892 | 0.899 |
| M-2 | 0.925 | 0.938 |
| M-3 | 0.929 | 0.875 |
| M-4 | 0.945 | 0.961 |
| Foam | 0.944 | 0.988 |

Notably, in all but one of the test specimens (M-3) an increase in the COR was measured with an increase in wall thickness of the blade. Further, the greatest percent increase in the COR from the thick walled blade over the thin walled blade was measured in the foam core blade construct.

Comparative spring rate testing was conducted on the silicone rubber samples (M-1 to M-4) and the foam core for both a thin and thick walled blade constructs. The test consisted of placing a load on the blade construct at a uniform load rate of 0.005 inches/second and obtaining load versus deflection curves. The maximum loads for the thin and thick walled composite blade constructs was 80 lbs and 150 lbs, respectively. The loads were placed on the same position on each of the blade constructs. The following data set forth in Table 4 below was obtained:

TABLE 4

| Material | Description: Spring Rate of Thin Blade Construct (tested [lbs/in]) | Description: Spring Rate of Thick Blade Construct (tested [lbs/in]) |
|---|---|---|
| M-1 | 6228.8 | 6877.0 |
| M-2 | 3674.5 | 5601.0 |
| M-3 | 4580.0 | 6768.5 |
| M-4 | 4850.9 | 6077.7 |
| Foam | 6131.9 | 6139.3 |

As can be seen from the data, the spring rate showed a significant increase between the thin and thick blade constructs for the silicone samples. The spring rate in the foam core construct, on the other hand, did not markedly increase with increased wall thickness.

Comparative vibration testing was also conducted on the thin and thick blade composite constructs. Measurements of maximum vibration amplitudes (measured in gravity increments) and a qualitative comparison of decay times were recorded. The test consisted of securing the composite blade construct at the hosel against an L-bracket and deflecting the blade at its toe a distance of 0.5 inches. Upon release of the deflected blade, vibration of the blade was measured via an accelerometer placed at 1.25 inches from the toe of the blade. The following data set forth below in Table 5 was recorded:

TABLE 5

| Material | Description: Max Accel. Of Thin Blade Construct (tested [g's]) | Description: Decay Time of Thin Blade Construct (tested [s]) | Description: Max Accel. Of Thick Blade Construct (tested [g's]) | Description: Decay Time of Thick Blade Construct (tested [s]) |
|---|---|---|---|---|
| M-1 | 5.75 | 0.67 | 88.0 | 0.54 |
| M-2 | 81.6 | 0.68 | 83.9 | 0.82 |
| M-3 | 77.2 | 0.87 | 93.7 | 0.72 |
| M-4 | 82.2 | 0.78 | 94.6 | 0.70 |
| Foam | 139.0 | 1.09 | 95.3 | 0.73 |

A similar vibration test was conducted on an all wood hockey stick blade. The data is set forth in Table 6 below:

TABLE 6

| Material | Description: Max Accel. (tested [g's]) | Description: Decay Time (tested [s]) |
|---|---|---|
| Wood | 18.7 | 1.09 |

Notably, the measurement of maximum acceleration is a measure of the initial vibration of the blade that occurs subsequent release of the deflected blade and is a reflection of the blade's capability to transmit vibration. The measurement of decay time is a measure of the duration or time required for the vibration of the blade to dissipate or be absorbed and therefore is a measure of the blades capability of dampening vibration.

With respect to the maximum acceleration data measured from the testing of the thin walled blade constructs, it is noted that the silicone rubber core constructs measured significantly less than the foam core construct. In addition, with respect to the decay times of the thin walled blade constructs, it is noted that the silicone rubber core constructs measured significantly less than the decay time of the foam core construct.

When one compares the maximum acceleration between the thin walled blade constructs and the thick walled blade constructs, it is noted that the silicone rubber core constructs tended to increase with blade wall thickness while the maximum acceleration of the foam core construct reflected a significant decrease. When one compares the decay times between the thin walled blade constructs and the thick walled blade constructs, it is noted that the silicone rubber constructs generally measured a slight decrease with increasing blade wall thickness where as the foam construct measured a significantly larger decrease in decay time with increasing blade wall thickness.

In addition, a qualitative comparison to the all wood blade construct indicates that although the maximum acceleration or vibration of the all wood construct measured less than any of the silicone rubber core constructs, the decay time was significantly greater in the all wood constructs than the silicone-rubber constructs.

Thus, the data suggest that an elastomer core is capable of effecting in a unique manner not only the spring rate and the COR as previously described and discussed, but it is also capable of providing a reduced decay time when compared to the foam and wood blade constructs as well as a decreased maximum acceleration closer to a wood blade construct than a traditional foam core construct.

"Bulk Molding Compound" Cores: Bulk molding compounds are generally defined as non-continuous fibers disposed in a matrix or resin base material, which when cured become rigid solids. Bulk molding compound can be employed as an inner core element or can form the totality of the blade 30 structure. This type of blade 30 or core 500 construction is best illustrated in FIG. 14K. When employed as either a blade 30 or core component 500 thereof, it is preferable that the bulk molding compound be cured in an initial molding operation, preferred steps for which are described in FIG. 15B. Initially, bulk molding compound is loaded into a mold configured for molding the desired exterior shape of the blade 30 or core element 500 (step 700 of FIG. 15B). With respect to the loading of the mold, it has been found preferable to somewhat overload the mold with the compound so that when the mold is sealed or closed, the excess compound material exudes from the mold. Such a loading procedure has been found to improve the exterior surface of the cured molded structure. Once the mold is loaded, heat is applied to the mold for curing (step 710), and the cured blade 30 or core element 500 is removed from the mold (step 720). Additionally, if required, the mold is finished to the desired appearance as a blade 30, or prepared for incorporation in the blade 30 as a core element 500.

Ply Materials/Fibers & Matrix/Resin

As used herein, the term "ply" shall mean "a group of fibers which all run in a single direction, largely parallel to one another, and which may or may not be interwoven with or stitched to one or more other groups of fibers each of which may or may not be disposed in a different direction." Unless otherwise defined, a "layer" shall mean one or more plies that are laid down together.

The fibers employed in plies 520 may be comprised of carbon fiber, aramid (such as Kevlar™ manufactured by Dupont Corporation), glass, polyethylene (such as Spectra™ manufactured by Allied Signal Corporation), ceramic (such as Nextel™ manufactured by 3m Corporation), boron, quartz, polyester or any other fiber that may provide the desired strength. Preferably, at least part of one of the fibers is selected from the group consisting of carbon fiber, aramid, glass, polyethylene, ceramic, boron, quartz, and polyester; even more preferably from the group consisting of carbon fiber, aramid, glass, polyethylene, ceramic, boron, and quartz; yet even more preferably from the group consisting of carbon fiber, aramid, glass, polyethylene, ceramic, and boron; yet even more preferably from the group consisting of carbon fiber, aramid, glass, polyethylene, and ceramic; yet even more preferably from the group consisting of carbon fiber, aramid, glass, and polyethylene; yet even more preferably from the group consisting of carbon fiber, aramid, and glass; yet even more preferably from the group consisting of carbon fiber and aramid; and most preferably comprises carbon fiber.

It has been found preferable that each uni-directional fiber ply be oriented so that the fibers run in a different and preferably a perpendicular direction from the underlying or overlying uni-directional ply. In a preferred construction lay-up, each ply is oriented so that the fibers run at preferably between +/−30 to 80 degrees relative to the longitudinal length of the blade 30 (i.e., the length from the heel section 140 to the tip section 130), and more preferably between +/−40 to 60 degrees, yet more preferably between +/−40 to 50 degrees, even more preferably between 42.5 and 47.5 degrees, and most preferably at substantially +/−45 degrees. Other ply orientations may also be independently or in conjunction with the foregoing orientations. For example, it has been found preferable that an intermediate zero degree oriented ply be included between one or more of the plies 520 to provide additional longitudinal stiffness to the blade 30. In addition, for example, a woven outer ply (made of e.g., Kevlar™, glass, or graphite) might be included to provide additional strength or to provide desired aesthetics. Furthermore, one or more plies may be employed which may or may not be uni-directional or woven. Moreover, it is to be understood that additional plies may be placed at discrete locations on the blade 30 to provide additional strength or rigidity thereto. For example, additional plies may be placed at or around the general area where the puck typically contacts the blade 30 during high impact shots (such as a slap shot), in an area where the blade typically meets the ice surface such as at or about the bottom edge 110, or in the general area on the blade 30 that is adapted to connect to the hockey stick shaft 20 or an adapter 1000 such as that illustrated in FIGS. 17A-D, for example the heel region 140, tongue 260 or hosel 450 portion of the blade 30, The matrix or resin-based material is selected from a group including: (1) thermoplastics such as polyether-ketone, polyphenylene sulfide, polyethylene, polypropylene, urethanes (thermoplastic), and Nylon-6, and (2) thermosets such as urethanes (thermosetting), epoxy, vinylester, polycyanate, and polyester.

In order to avoid manufacturing expenses related to transferring the resin into the mold, the matrix material may be pre-impregnated into the fibers or filaments, plies 520 or layers 510 prior to the uncured blade assembly being inserted into the mold and the mold being sealed. In addition, in order to avoid costs associated with employment of woven sleeve materials, it may be preferable that the layers 510 be comprised of one or more plies 520 of non-woven uni-directional fibers. Applicants have found that a suitable material includes uni-directional carbon fiber tape pre-impregnated with epoxy, manufactured by Hexcel Corporation of Salt Lake City, Utah, and also S & P Systems of San Diego, Calif. Another suitable material includes uni-directional glass fiber tape pre-impregnated with epoxy, also manufactured by Hexcel Corporation. Yet another suitable material includes uni-directional Kevlar™ fiber tape pre-impregnated with epoxy, also manufactured by Hexcel Corporation.

Employment of such pre-impregnated materials has been found by applicants to be particularly suitable for serving as an adhesive to secure the layers of fibers or one or more plies to one another, as well as to the core or other structural component. Hence, the employment of these materials may serve to facilitate the fixing of the relative position of the pre-cured blade assembly components. Moreover, such pre-impregnated materials have been found advantageous when employed internally in so much as the resin need not flow or otherwise be transferred into the internal portions of the blade 30 during the curing molding and curing process of the blade assembly. For example, internal structures, such as the bridge structures 530 of the various blade 30 constructions illustrated in FIGS. 14B-14F, 141 and 14J, as well as the internal ply layers 510 best illustrated in FIGS. 14G and 14J and 18B, are particularly suited to being formed from such pre-impregnated materials. By pre-positioning the resin in the desired locations, control over the disposition of the resin in the internal structure component(s) can be exercised, such as at the bridge structure 530 as well as the internal layers 510 or plies 520.

Exemplary Alternative Blade Construction Configurations

Exemplary alternative blade 30 constructions illustrated in FIGS. 14A through 14K and 18A-B are described in turn below. It is to be understood that the various cores may be comprised of various materials (e.g., foam, wood, wood laminate, elastomer material, bulk molding compound, etc.) to achieve desired performance characteristics and/or unique feel.

Figure 15A:
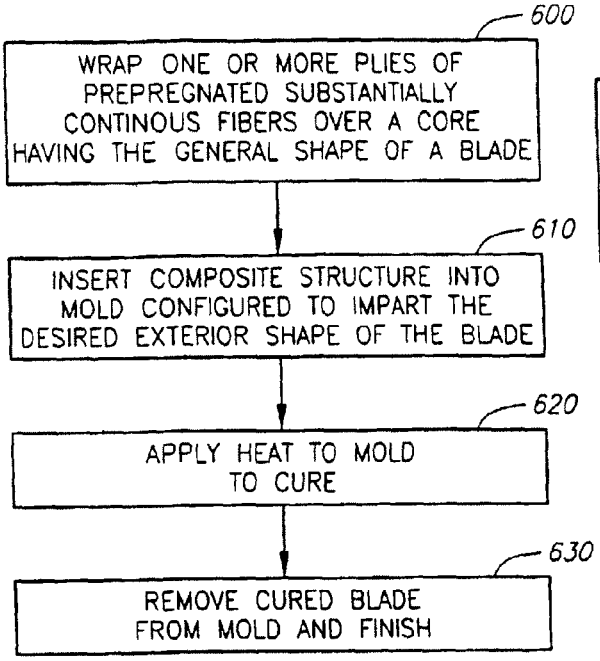
FIG. 15A is a flow chart detailing preferred steps for manufacturing the hockey stick blade illustrated in FIGS. 14A through 14J.

With reference to FIG. 15A, the blade 30 constructions illustrated in FIGS. 14A through 14F and 18B are generally constructed in accordance with the following preferred steps. First, one or more plies 520, layers, or groups of fibers or filaments are wrapped over one or more inner core elements 500*a*-500*c* (e.g., wood, wood laminate, elastomer material, foam, bulk molding compound, etc.), which individually or in combination generally form the shape of the blade 30 illustrated in FIG. 3, 7, or 13 (step 600) to create an uncured blade assembly.

Once the uncured blade assembly is prepared, it is inserted into a mold that is configured to impart the desired exterior shape of the blade 30 or component thereof (step 610 of FIG. 15A). The mold is then sealed, after which heat is applied to the mold to cure the blade assembly (step 620 of FIG. 15A). The blade 30 is then removed from the mold and finished to the desired appearance (step 630 of FIG. 15A). The finishing process may include aesthetic aspects such as paint or polishing and also may include structural modifications such as deburring. Once the blade 30 is finished, the blade 30 is then ready for attachment to the shaft 20.

It is to be understood that in order to avoid subsequently injecting resin or matrix material into the mold after the blade assembly is placed therein (such as in a conventional resin transfer molding (RTM) processes described above) a preferred construction process employs fibers, plies or layers of fiber plies that are pre-impregnated with a resin or matrix, as previously noted. An RTM method or a combination of an RTM and pre-preg method process may be employed, however, if desired for a given application.

As shown in the preferred embodiment illustrated in FIG. 14A, a three-piece core 500*a*, 500*b*, and 500*c* is employed. Overlaying the centrally positioned core element 500*b* are two plies 520*a* and 520*b*. In application, plies 520*a* and 520*b* may be wrapped around core element 500*b* as a single layer. Once plies 520*a* and 520*b* are wrapped around the core element 500*b*, plies 520*c*, 520*d*, and 520*e* are wrapped over plies 520*a* and 520*b* and around core elements 500*a* and 500*c*. The uncured blade assembly is then inserted into a suitable mold configured to impart the desired exterior shape of the blade 30, as previously discussed in relation to step 610 of FIG. 15A. Once cured, plies 520*a* and 520*b* create internal bridge structures 530 that extend from one side of the blade 30 to the other (i.e., from the inner facing surface of ply 520*c* on one side of the blade to the inner facing surface of ply 520*c* on the other side of the blade 30) and thereby may provide additional internal strength or impact resistance to the blade 30.

The internal bridge structure 530 previously referenced in relation to FIG. 14A, and also illustrated and discussed in relation to FIGS. 14B through 14F, may extend only along a desired discrete portion of the longitudinal length (i.e., the length from the heel to the tip section) of the blade 30. However, an advantage that may be realized by employing an internal bridge structure(s) that extend into the recessed or tongue portion 260 of the heel 140 of the blade 30 is the capability of imparting additional strength at the joint between the blade 30 and the shaft 20. Moreover, by extending the internal bridge structure(s) into the tongue 260 of the blade 30, a potentially more desirable or controlled blade 30 flex may be capable at the joint.

FIGS. 14B and 14C illustrate second and third preferred constructions of the blade 30, each of which also comprises a plurality of inner core elements 500*a*, 500*b* and 500*a*, 500*b*, 500*c*, respectively. Three plies 520*a*, 520*b*, and 520*c* overlay the inner core elements. The positions of the interface, or close proximity of the plies 520 on opposite sides of the blade 30 (i.e., positions where opposed sides of ply 520*a*, 520*b*, and 520*c* are positioned in close proximity towards one another so that opposed sides of ply 520*a* are preferably touching one another), cause the formation of internal bridge structure(s) 530 interposed between the core elements. The function and preferred position of the internal bridge structure(s) 530 are the same as those described in relation to FIG. 14A.

In application, the bridge structure(s) 530 illustrated in FIGS. 14B and 14C can be implemented by the following process. First, a single core 500, having generally the shape of the blade 30, is provided and wrapped with plies 520*a*, 520*b*, and 520*c* to create an uncured blade assembly (step 600 of FIG. 15A). The blade assembly is then inserted into a mold having convex surfaces configured to impart the desired bridge structure 530 into the blade 30 (step 610 of FIG. 15A). The convex surfaces force the core structure out of the defined bridge structure region and create a bias that urges the internal sides of the plies toward one another at that defined region. The convex surface(s) may be integral with the mold or may be created by insertion of a suitable material, such as expanding silicone, into the mold at the desired location(s).

Thus, in a preferred application, a single core element 500 is partitioned during the molding process to create the discrete core elements. Such a process is capable of reducing the manufacturing costs and expenditures related to forming a multi-piece core structure, as well as the time associated with wrapping the plies about a multi-piece core structure, as described above in relation to the core element 500*b* of FIG. 14A. In order to create a more desirable blade surface configuration after the blade assembly is cured, the cavities 540 formed by this process may be filled by a suitable filler material 570 such as fiberglass, urethane, epoxy, ABS, styrene, polystyrene, resin or any other suitable material to effectuate the desired outer surface and performance results. Filling the cavities 540 with urethane, for example, may assist in gripping the puck.

FIG. 14D illustrates a fourth preferred construction of the blade 30, which also comprises a plurality of inner core elements 500*a* and 500*b* overlain with three plies 520*a*, 520*b*, and 520*c*. Extending between the inner core elements 500*a* and 500*b* is a bead 590 of preferably pre-impregnated fiber material, such as carbon or glass fiber. A preferred construction process includes the following steps. First, a core element 500, generally having the shape of the blade 30, is provided, and a cavity or slot is imparted (e.g., by mechanical means) within the core element 500 along a portion of its longitudinal length (i.e., generally from the heel section to the toe section) so as to define core elements 500*a* and 500*b*. Alternatively, the core element 500 may be molded to include the cavity or slot, thus avoiding the costs associated with mechanical formation of the cavity or slit into the core element 500. As previously noted in relation to the internal bridge structure 530 of FIG. 14A, the bead 590 preferably extends longitudinally into the tongue 260 of the blade 30 so that it may provide additional strength at the joint between the shaft 20 and the blade 30. The cavity or slot is filled with a bead of preferably pre-impregnated fibers. The fiber bead may be comprised of a single layer of substantially continuous pre-impregnated fibers that are rolled or layered to achieve the desired dimensions to fill the cavity/slot. Alternatively, the bead may be comprised of a non-continuous fiber and resin mixture referred to in the industry as "bulk molding compound" or an elastomer material. The fibers in the bulk molding compound may be selected from the group of fibers previously identified with respect to the substantially continuous fibers employed in plies 520. Once the bead of fiber material is laid in the cavity between core elements 500*a* and 500*b*, plies 520*a*, 520*b*, and 520*c* are wrapped around the foam core elements to form an uncured blade assembly (step 600 of FIG. 15A). The uncured blade assembly is then inserted into a mold having the desired exterior shape of the blade 30 (step 620 of FIG. 15A), and heat is applied to the mold for curing (step 630 of FIG. 15B). The bead 590 of fiber material forms an internal bridge structure 530 between opposing sides of the blade 30, and is disposed between the core elements 500*a* and 500*b*, the function of which is as previously noted in relation to the bridge structure 530 discussed in relation to FIG. 14A.

Figures 16, 16A:
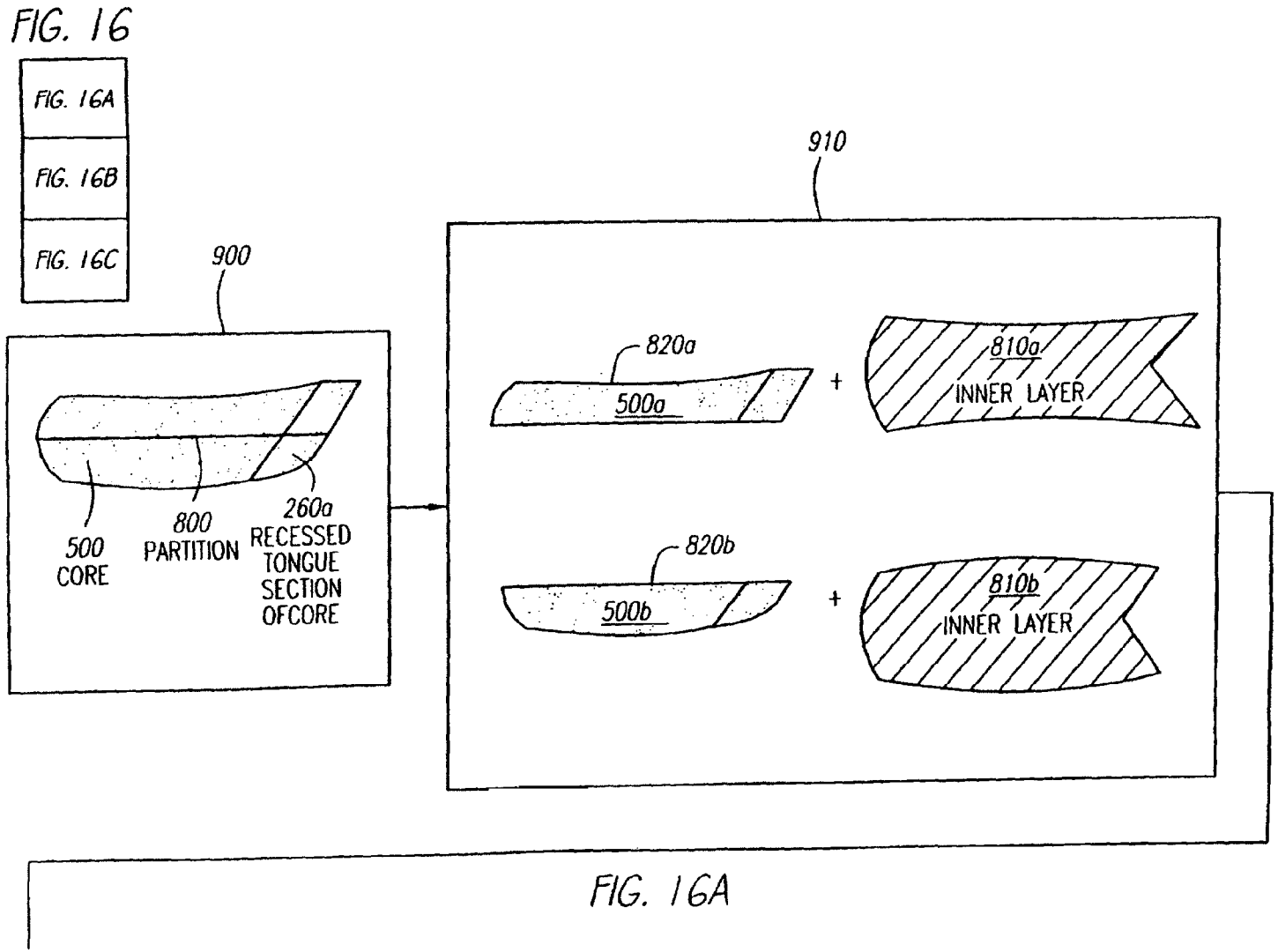
FIGS. 16A-C together comprise a flow chart of exemplary graphical representations detailing preferred steps for manufacturing the hockey stick blade illustrated in FIG. 14E.
Figure 16B:
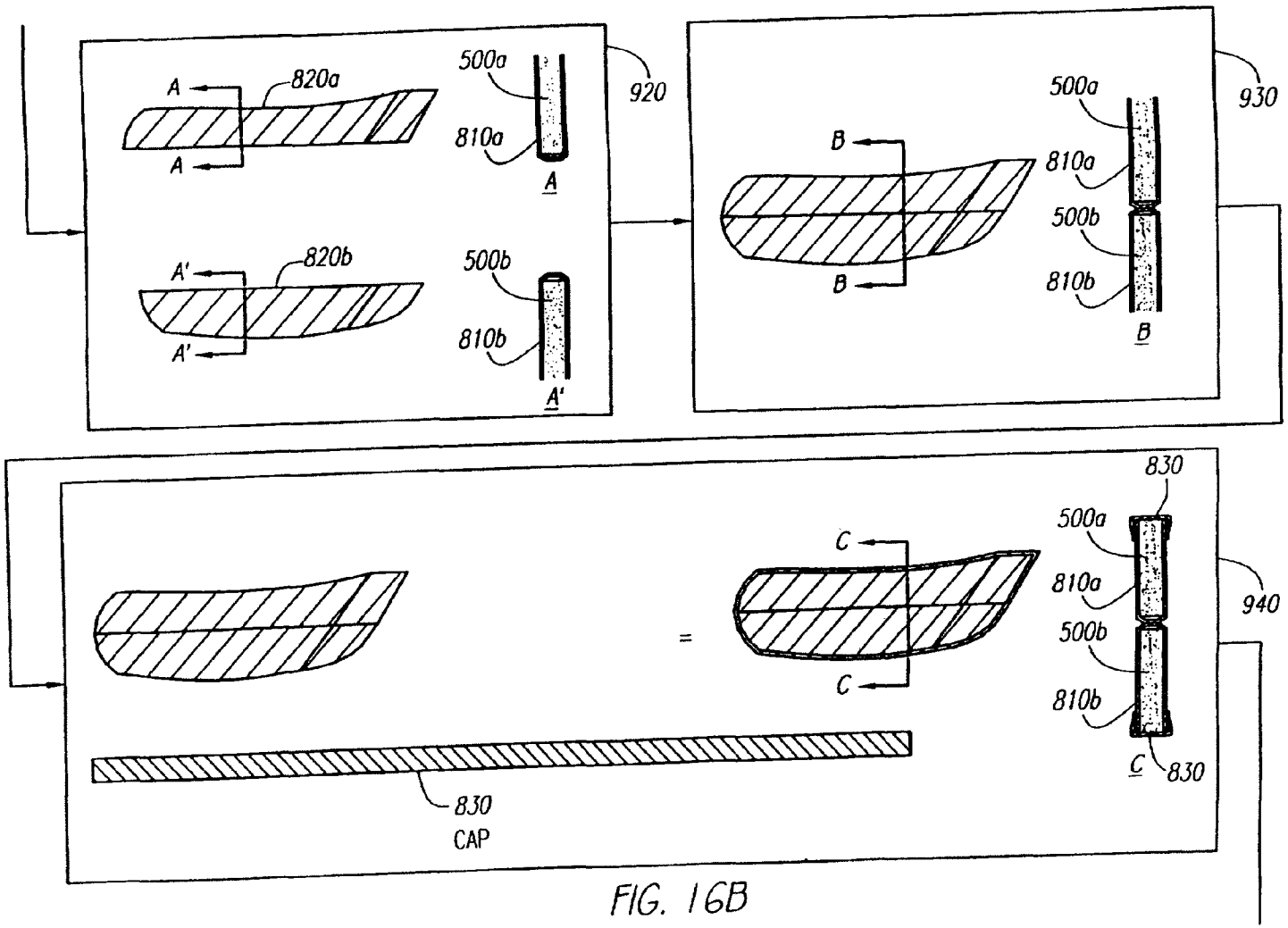

FIG. 14E illustrates a fifth preferred construction of the hockey stick blade 30. In addition to the preferred steps set forth in FIG. 15A, a preferred process for manufacturing this preferred construction is set forth in more detail in FIGS. 16A-16C. With reference to FIG. 14E, the preferred steps described and illustrated in FIGS. 16A-16C (steps 900 through 960) will now be discussed. First, as illustrated in FIG. 16A, a core 500 is provided and is preferably configured to include a recessed tongue section 260*a* at the heel section 140 of the blade 30 (step 900). The core 500 may preferably be molded to have a partition 800 that generally extends the longitudinal length of the blade 30 from the tip section 130 to the heel section 140. Alternatively, the partition 800 may be mechanically imparted to a unitary core structure 500.

The core 500 is then separated along partition line 800 into core elements 500*a* and 500*b*, and inner layers 810*a* and 810*b* are provided (step 910). As illustrated in step 910, the inner layers 810*a* and 810*b* are preferably dimensioned such that, when they are wrapped around the respective core elements 500*a* and 500*b*, they extend to the respective upper edges 820*a* and 820*b* of the foam core 500*a* and 500*b* (step 920 of FIG. 16B). With reference to FIG. 14E, each layer 810*a* and 810*b* is preferably comprised of two plies 520*a* and 520*b*, but any other suitable number of plies may be employed.

Layers 810*a* and 810*b* at the partition 800 are then mated together so that layers 810*a* and 810*b* are interposed within the partition 800 (step 930). Preferably, this may be achieved by touching the mating surfaces of layers 810*a* and 810*b* to a hot plate or hot pad to heat the resin pre-impregnated in the plies 520*a* of the outer layers 810*a* and 810*b* and thereby facilitate adhesion of the layers 810*a* and 810*b* to one another.

A cap layer 830 may be wrapped around the circumference of the blade assembly (step 940). When employed, the cap layer 830 is preferably dimensioned so that its length is sufficient to completely reach the outer edges of the foam core elements 500*a* and 500*b* when mated together at the partition 800, as described in relation to step 930. In addition, as best illustrated in step 940 and FIG. 14F, the width of the cap layer 830 is dimensioned so that when the cap layer 830 is wrapped around the circumference of the core elements 500*a* and 500*b*, the cap layer 830 overlaps the outer surfaces of layers 810*a* and 810*b*. As best illustrated in FIG. 14E, the cap layer 830 is preferably comprised of two plies 560*a* and 560*b*, but any other suitable number of plies may be employed.

Figure 16C:
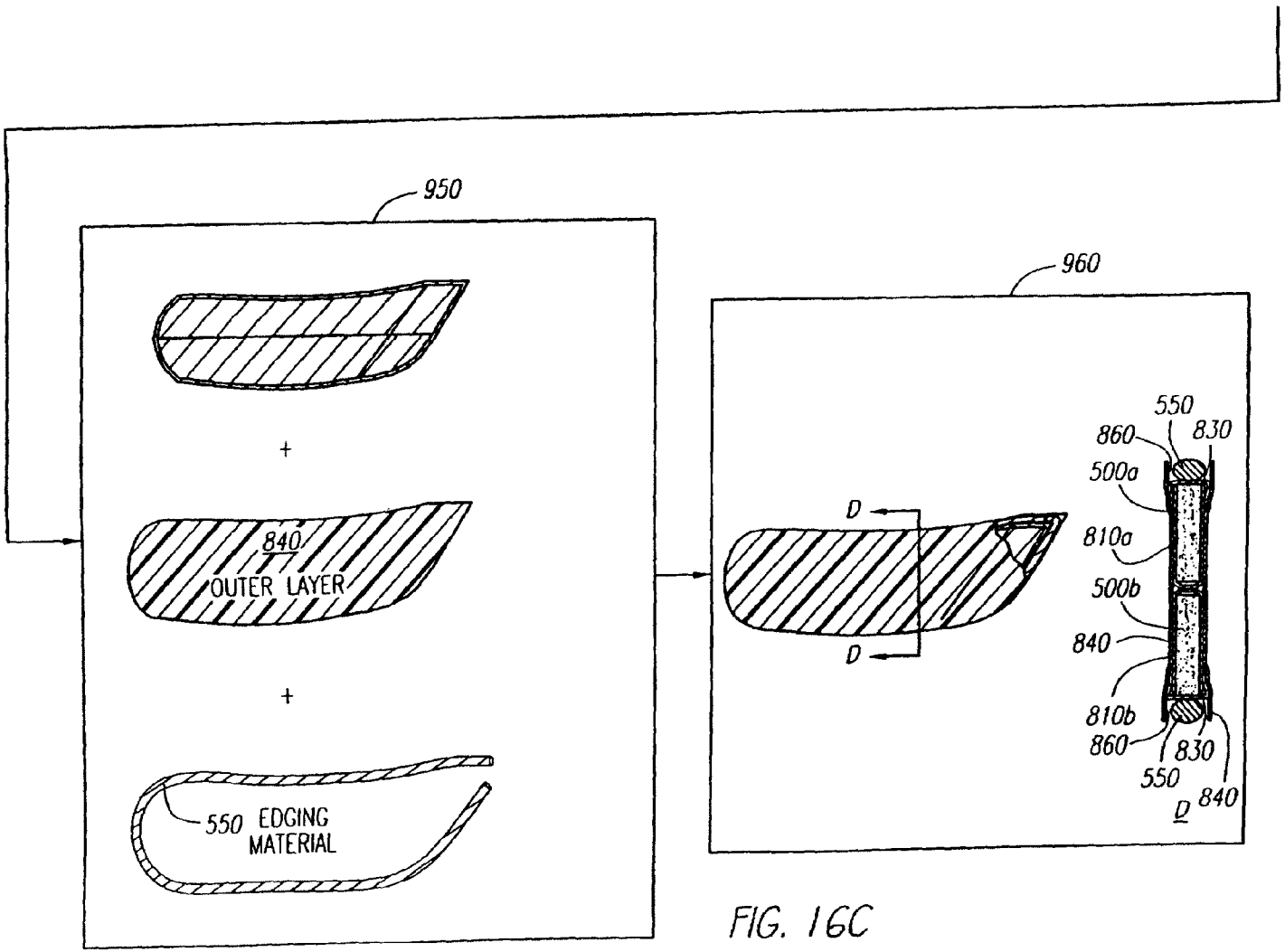

As illustrated at step 950 of FIG. 16C, outer layers 840 (only a single outer layer 840 is illustrated in step 950) and an edging material 550 may be employed. The edging material may be in the form of twine or rope and may be comprised of a variety of materials suitable for providing sufficient durability to the edge of the blade 30, such as bulk molding compound of the type previously described, fiberglass, epoxy, resin, elastomer material, or any other suitable material. It has been found preferable, however, that fiberglass twine or rope be employed, such as the type manufactured by A & P Technology, Inc. of Cincinnati, Ohio. Each of the outer layers 840, as best-illustrated in FIG. 14E, are also preferably comprised of two plies 520*c* and 520*d*. The outer layers 840 are preferably dimensioned to be slightly larger than the foam core elements 500*a* and 500*b* when mated together, as described at step 940.

As described and illustrated at step 960, the outer layers 840 are mated to the outer sides of the blade assembly illustrated at step 950, such that a channel 860 is formed about the circumference of the blade assembly. The edging material 850 is then laid in the channel 860 about the circumference of the blade assembly to create the final uncured blade assembly. The uncured blade assembly is then inserted into a suitable mold configured to impart the desired exterior shape of the blade 30 (step 610 of FIG. 15A). Heat is then applied to the mold for curing (step 620 of FIG. 15A), after which the cured blade 30 is removed from the mold and finished for attachment (step 630 of FIG. 15A). Notable is that the construction process described in relation to FIGS. 16A-C has been found to be readily facilitated by the inherent adhesion characteristics of the employment of pre-impregnated fibers, layers, or plies, as the case may be.

FIG. 14F illustrates a sixth preferred construction of the hockey stick blade 30, which also comprises a plurality of inner core elements 500*a* and 500*b* overlain with plies 520*a* and 520*b*. As in the construction illustrated in FIG. 14D, extending between the inner core elements 500*a* and 500*b* is a bead 590 of suitable materials (e.g., such as pre-impregnated fiber material, bulk molding compound, elastomer, etc.) that forms an internal bridge structure 530. An edging material 550, such as that discussed in relation to FIG. 14E, may preferably be placed around the circumference of the blade 30. In application, the incorporation of the bead of material may be achieved as discussed in relation to FIG. 14D. Once the bead material is disposed between the core elements 500*a* and 500*b*, the remaining construction is similar to that discussed in relations to steps 950 and 960 of FIG. 16C. Namely, (1) oversized outer layers are mated to the core elements having the bead material disposed there between, (2) the edging material 550 is wrapped around the circumference of the core members 500*a* and 500*b* in the channel created by the sides of the outer layers, and (3) the uncured blade assembly is loaded into a mold for curing and cured at the requisite temperature, pressure and duration.

FIG. 14K illustrates a seventh preferred construction of the hockey stick blade 30 and FIG. 15B details the preferred steps for manufacturing the blade 30 illustrated in FIG. 14K. This construction method is also applicable for manufacturing one or more core 500 elements of the blade. In this preferred construction, bulk molding compound (i.e., non-continuous fibers disposed in a matrix material or resin base) of the type previously described is loaded into a mold configured for molding the desired exterior shape of the blade 30 or core element (step 700 of FIG. 15B). With respect to the loading of the mold, it has been found preferable to somewhat overload the mold with compound, so that when the mold is sealed or closed, the excess compound material exudes from the mold. Such a loading procedure has been found to improve the exterior surface of the blade 30 or core element resulting from the curing process. Once the mold is loaded, heat is applied to the mold to cure (step 710) and the cured blade 30 or core element is removed from the mold and finished, if necessary, to the desired appearance (step 720) or otherwise employed as an inner core element.

It is to be understood that one or more of the foregoing core elements described in relation to the foregoing exemplary blade constructs may be comprised of various materials including one or more elastomer materials, as previously discussed. Moreover, the core components may comprise discrete regions of different materials. For example, the core may be comprised of region formed of elastomer material and one or more other region formed of: foam, fibers or filaments disposed in a hardened resin or matrix material, wood or wood laminate, and/or bulk molding compound.

FIG. 14G illustrates a preferred embodiment of a hockey blade 30 having a core comprising alternating layers of a "elastomer" material. Overlying the elastomer the layers of elastomer materials or interposed there between are layers formed of one or more of the following materials, fibers disposed in a hardened resin matrix (e.g., composite), wood, wood laminate, foam, bulk molding compound, or other suitable material. While any of these materials may be employed to alternate with the elastomer material, fibers disposed within a hardened resin matrix has been found to be suitable, and will therefore be described below for ease of description. FIG. 14G depicts four composite layers 510 alternating with three elastomer layers 500*a-c*. It is to be understood that a greater or lesser number of each type of layer may be employed to meet given performance requirements. Each of the elastomer layers may be comprised of the same elastomer material or a different elastomer material. In addition, one or more elastomer layers may comprise a mixture of more than one elastomer material or a compilation of multiple layers of different elastomer materials.

Each composite layer 510 preferably comprises two to eight fiber plies, more preferably two to four fiber plies, to provide desired strength to the blade 30. The number of plies employs may vary given the desired performance and the characteristics of the fibers that comprise the plies. In FIGS. 14G-14J, each composite layer 510 is shown as a single continuous layer, for ease of illustration, but it is to be understood that each composite layer 510 preferably comprises more than one fiber ply. By alternating layers of composite and elastomer material in the core, the strength and elasticity of the blade 30 may be varied to uniquely effectuate the performance and feel characteristics of the blade 30.

Fiber plies pre-impregnated with resin or other suitable matrix material, as described above, are particularly suitable for constructing the composite layers 510 of the embodiments shown in FIGS. 14G and 14J (described below). This is so, because those layers traverse internally within the blade and are separated by the interposed elastomer layers—hence injection of resin into each of the alternating composite layers using a traditional RTM process may pose a significant hurdle to manufacturing the blade with controlled or consistent tolerances. Pre-impregnated plies, on the other hand are formed with the desired resin matrix in place, which thereby facilitates control over the distribution of the resin matrix for appropriate encapsulation of the fibers that are to be disposed therein. In addition, the tackiness of pre-impregnated tape plies, previously discussed are conducive to preparation of the pre-cured assembly in as much as they facilitate alignment and adhesion between the core components and the outer wall components of the blade assembly prior to curing Thus, the use of pre-impregnated composite layers 510 is particularly preferred in these embodiments.

Figure 14H:
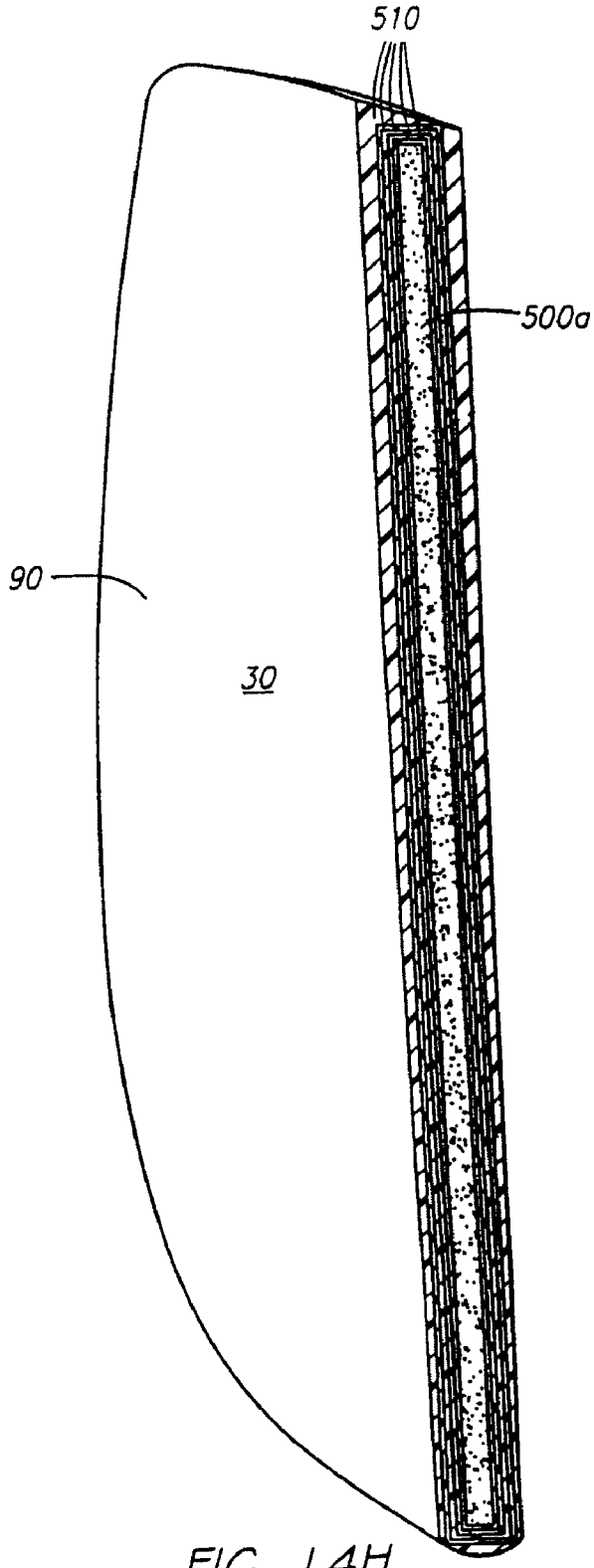
FIG. 14H is a cross-sectional view taken along line 14-14 of FIGS. 3, 7 and 13 illustrating an eighth alternative construction of the hockey stick blade.
Figure 14I:
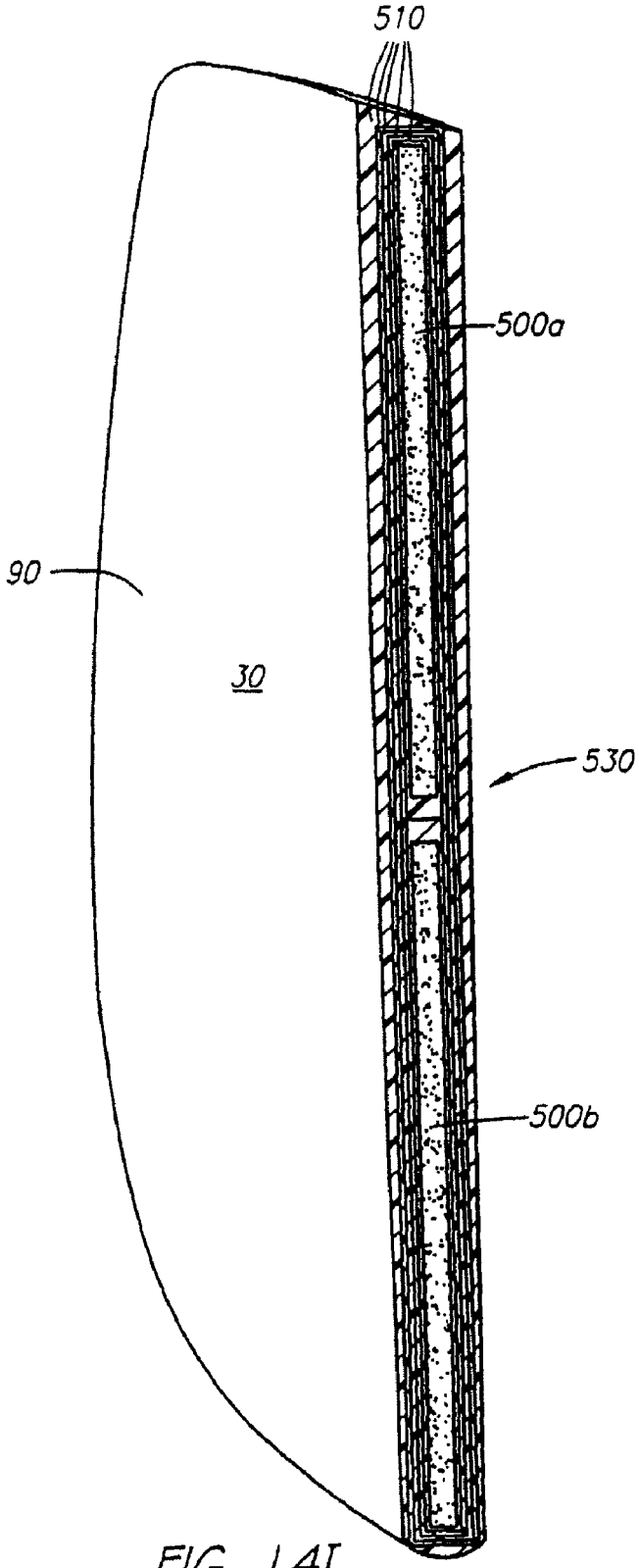
FIG. 14I is a cross-sectional view taken along line 14-14 of FIGS. 3, 7 and 13 illustrating a ninth alternative construction of the hockey stick blade.
Figure 14J:
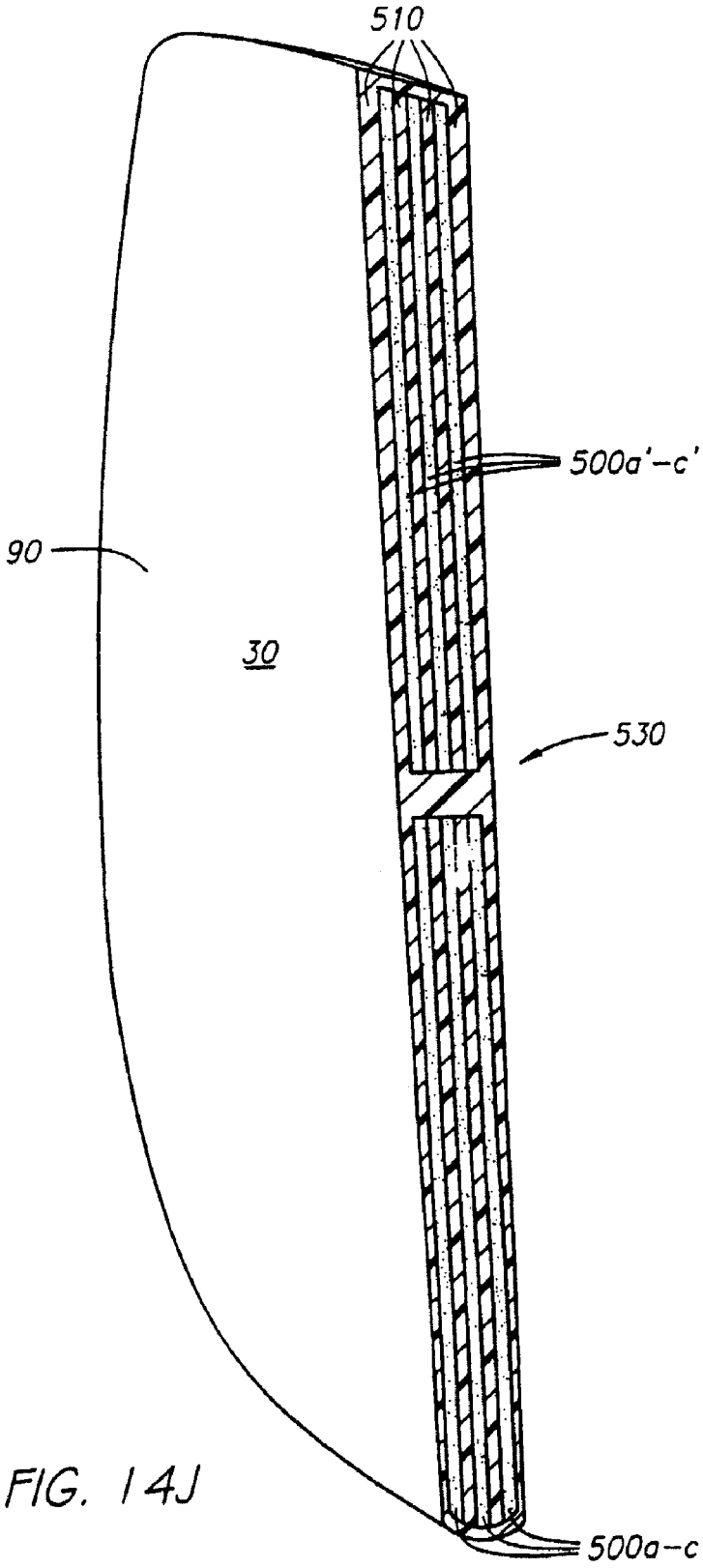
FIG. 14J is a cross-sectional view taken along line 14-14 of FIGS. 3, 7 and 13 illustrating a tenth alternative construction of the hockey stick blade.
Figure 15B:
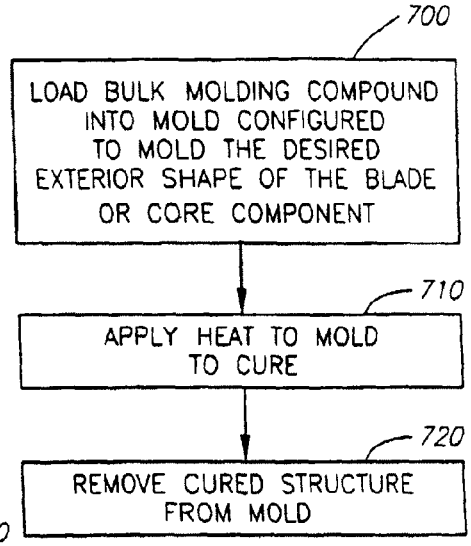
FIG. 15B is a flow chart detailing preferred steps for manufacturing the hockey stick blade or core component thereof illustrated in FIG. 14K.

FIG. 14H illustrates an alternative preferred embodiment wherein the core comprises a continuous elastomer material 500*a* encased within a plurality of fiber plies 510 disposed in a hardened resin matrix. Employment of a single continuous core element of elastomer material 500*a*, resiliency, elasticity as well as other physical properties derived from the given elastomer material employed may be particularly emphasized in the blade 30.

FIG. 141 illustrates the blade construction of FIG. 14H having a rib or bridge structure 530 of composite material, or other suitable material as described above, extending from a composite layer inside the front face 90 of the blade 30 to a composite layer inside the rear face of the blade 30, in a manner similar to that described with regard to FIGS. 14D-14F. The bridge structure 530 is capable dispersing or distributing loads or impacts applied to the blade 30 (e.g., by a hockey puck) from the front face 90 to the rear face of the blade 30, as well as adding strength to the blade. FIG. 14J illustrates the blade construction of FIG. 14G having a similar bridge structure 530 extending through the alternating layers of composite and elastomer materials. The bridge structure 530 preferably extends from a composite layer inside the front face 90 of the blade 30 to a composite layer inside the rear face of the blade 30, as described above.

In an alternative construction, the core of the blade 30 may include foam, such as EVA foam or polyurethane foam, in combination with and/or surrounding one or more elastomer core elements. The foam core element may be disposed between elastomer core elements and an inner and/or outer (the layers that form the front or back faces of the blade) composite layers. For example the foam core element may be disposed adjacent to the composite front and/or back faces of the blade formed of fibers disposed in a hardened resin matrix and an elastomer core element may be disposed more internally thereto. Another example of such a construction may be comprised of a foam core element disposed at or near the top and/or bottom portions of the blade 30 and an elastomer core element disposed vertically intermediate thereto. Alternatively, the elastomer core elements may be layered either horizontally or vertically or otherwise combined with foam throughout discreet or continuous portions of the blade 30. The formation of a core comprising foam and elastomer elements, provides the additional capability of obtaining the benefits discussed herein relating to those materials and thereby provides additional capability of manipulating the desired performance and feel of the blade 30.

Figure 18A:
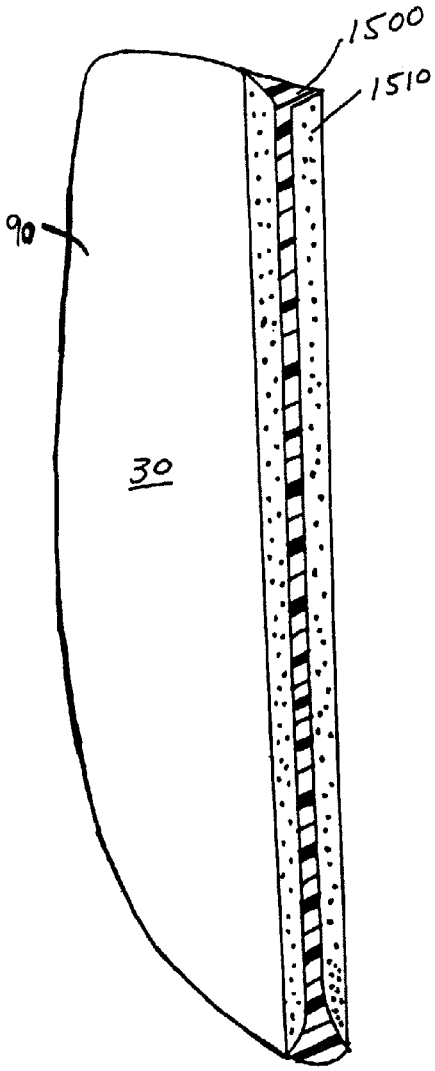
FIG. 18A is a cross-sectional view taken along line 14-14 of FIGS. 3, 7, and 13 illustrating an alternative blade construction wherein the hockey stick blade comprises a composite core overlain by an "elastomer" outer surface.
Figure 18B:
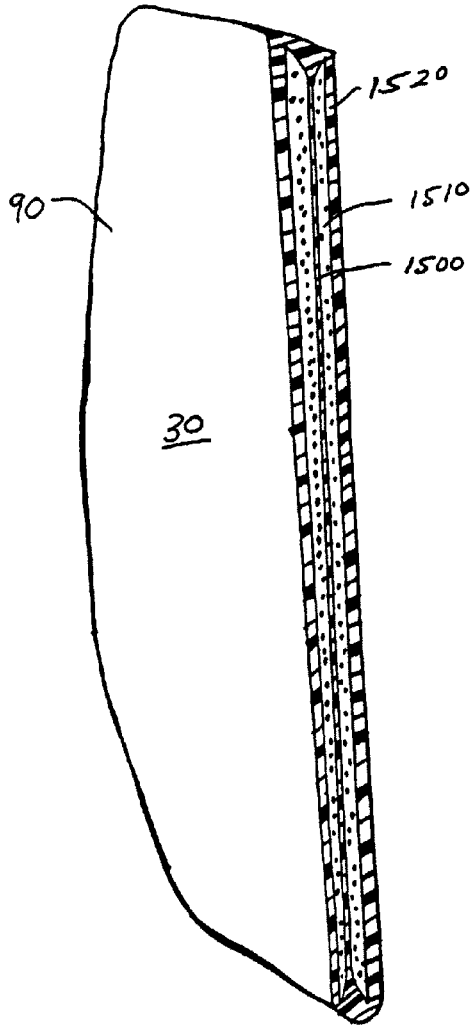
FIG. 18B is a cross-sectional view taken along line 14-14 of FIGS. 3, 7, and 13 illustrating an alternative blade construction wherein the hockey stick blade comprises an "elastomer" layer sandwiched between a composite core and composite outer surfaces.

FIGS. 18A and 18B illustrate alternative blade constructions in which the core of the blade 30 comprises a matrix or resin material 1500, surrounded by a resilient or elastic material 1510, such as natural rubber, silicone, or one or more other elastomer material described herein. The resilient or elastic material 1510 may comprise the outer surfaces of the blade, as illustrated in FIG. 18A, or it may be overlain by one or more additional layers of composite material 1520, as illustrated in FIG. 18B. By overlaying a matrix or resin material with a elastomer material, the resilience and elasticity of the blade 30 may be further modified to meet desired performance and feel requirements.

It is to be appreciated and understood that shafts 20, illustrated in FIGS. 1-2 and 5-6, may be constructed of various materials including wood or wood laminate, or wood or wood laminate overlain with outer protective material such as fiberglass. Such a shaft 20 construction, in combination with any of the blade constructions described herein, results in a unique hybrid hockey stick configuration (e.g., a traditional "wood" shaft attached to a "composite" blade), which may provide desired "feel" characteristics sought by users. Additionally, one or more of the elastomer materials described herein may be employed as core elements in portions of the shaft, as well as the hosel, and/or the adapter section, to further modify the feel and performance characteristics of the blade, shaft, and stick.

In addition, it should also be understood that while all or a portion of the recessed tongue portion 260 of the heel 140 may be comprised of a foam or elastomer core overlain with plies or groups of fibers disposed in a matrix material; it may also be preferable that all or a portion of the recessed tongue portion 260 of the heel 140 be comprised without such core elements or may be comprised solely of fibers disposed in a hardened matrix material. Such a construction may be formed of plies of unidirectional or woven fibers disposed in a hardened resin matrix or bulk molding compound. Employment of such a construction in part or throughout the tongue 260 or joint between the blade and the joined member (e.g., shaft or adapter member) is capable of increasing the rigidity or strength of the joint and/or may provide a more desirable flex as was described in relation to the internal bridge structure(s) 530 described in relation to FIGS. 14A-14J.

While there has been illustrated and described what are presently considered to be preferred embodiments and features of the present invention, it will be understood by those skilled in the art that various changes and modifications may be made, and equivalents may be substituted for elements thereof, without departing from the scope of the invention.

In addition, many modifications may be made to adapt a particular element, feature or implementation to the teachings of the present invention without departing from the central scope of the invention. Therefore, it is intended that this invention not be limited to the particular embodiments disclosed herein, but that the invention include all embodiments falling within the scope of the appended claims. In addition, it is to be understood that various aspects of the teachings and principles disclosed herein relate configuration of the blades and hockey sticks and component elements thereof. Other aspects of the teachings and principles disclosed herein relate to internal constructions of the component elements and the materials employed in their construction. Yet other aspects of the teachings and principles disclosed herein relate to the combination of configuration, internal construction and materials employed therefor. The combination of one, more than one, or the totality of these aspects define the scope of the invention disclosed herein. No other limitations are placed on the scope of the invention set forth in this disclosure. Accordingly, the invention or inventions disclosed herein are only limited by the scope of this disclosure that supports or otherwise provides a basis, either inherently or expressly, for patentability over the prior art. Thus, it is contemplated that various component elements, teachings and principles disclosed herein provide multiple independent basis for patentability. Hence no restriction should be placed on any patentable elements, teachings, or principles disclosed herein or combinations thereof, other than those that exist in the prior art or can under applicable law be combined from the teachings in the prior art to defeat patentability.

What is claimed is:

1. A multi-core, composite blade for a hockey stick, comprising:

an elongated member extending longitudinally from a tip section to a heel section and vertically from a top section to a bottom section to form a front-facing wall and a generally opposing back-facing wall, with the front and back-facing walls spaced apart at their mid-sections and merged together at their perimeter edges to define a cavity there between;

a plurality of inner core elements in the cavity;

wherein at least one of the inner core elements is formed of an elastomeric material, and at least one of the inner core elements is formed of a non-elastomeric, foam material.

2. The hockey stick blade of claim 1 wherein the elastomeric material is selected from the group consisting of butadiene, natural rubber, synthetic rubber, silicone, urethane, neoprene, polyester, di-cyclo pendadiene monomer, and expanded polypropylene.

3. The hockey stick blade of claim 1 wherein the elastomeric material has an ultimate elongation percentage greater than or equal to 100 percent.

4. The hockey stick blade of claim 1 wherein at least two of the inner core elements are formed of an elastomeric material, and at least one of the inner core elements is formed of a non-elastomeric material that is interposed between the two elastomeric inner core elements.

5. The hockey stick blade of claim 1 wherein the at least one elastomeric inner core element is spaced longitudinally from the at least one non-elastomeric, foam inner core element.

6. The hockey stick blade of claim 1 wherein the at least one elastomeric inner core element is spaced vertically from the at least one non-elastomeric, foam inner core element.

7. The hockey stick blade of claim 1 wherein the at least one elastomeric inner core element extends from the front-facing wall to the back-facing wall of the blade.

8. The hockey stick blade of claim 1 wherein the at least one elastomeric inner core element extends from the top of the blade to the bottom of the blade.

9. The hockey stick blade of claim 1 wherein the at least one elastomeric inner core element extends longitudinally from the tip region to the heel region of the blade.

10. The hockey stick blade of claim 1 further comprising a bridge structure interposed between the front and back-facing walls, wherein the bridge structure is formed of a non-elastomeric material.

11. The hockey stick blade of claim 10 wherein the bridge structure is formed of fibers disposed within a hardened resin matrix.

12. The hockey stick blade of claim 10 wherein the bridge structure extends vertically from the top section to the bottom section of the blade.

13. The hockey stick blade of claim 10 wherein the bridge structure extends longitudinally from the heel section to the tip section of the blade.

14. A multi-core, composite blade for a hockey stick, comprising:

an elongated member extending longitudinally from a tip section to a heel section and vertically from a top section to a bottom section to form a front-facing wall and a generally opposing back-facing wall, with the front and back-facing walls spaced apart at their mid-sections and merged together at their perimeter edges to define a cavity there between;

a plurality of inner core elements in the cavity;

wherein at least one of the inner core elements is formed of a foam material, and at least two of the inner core elements are formed of an elastomeric material, wherein the foam inner core element is interposed between the two elastomeric inner core elements.

15. The hockey stick blade of claim 14 wherein a plurality of the inner core elements comprise an elastomeric material, and a plurality of the inner core elements comprise a foam material, wherein the elastomeric inner core elements and the foam inner core elements are positioned in an alternating manner in the cavity in a direction substantially perpendicular to the longitudinal length of the blade.

16. A multi-core, composite blade for a hockey stick, comprising:

an elongated member extending longitudinally from a tip section to a heel section and vertically from a top section to a bottom section to form a front-facing wall and a generally opposing back-facing wall, with the front and back-facing walls spaced apart at their mid-sections and merged together at their perimeter edges to define a cavity there between;

at least one elastomeric inner core element in the cavity; and at least one non-elastomeric, foam inner core element in the cavity positioned vertically above the at least one elastomeric inner core element.

* * * * *